US006991136B2

(12) United States Patent
de la Guardia

(10) Patent No.: US 6,991,136 B2
(45) Date of Patent: Jan. 31, 2006

(54) PRESSURIZING DEVICE FOR ATTACHMENT TO FLUID CONTAINERS

(76) Inventor: Mario Felix de la Guardia, 5740 SW. 4th Ct., Plantation, FL (US) 33317

( * ) Notice: Subject to any disclaimer, the term of this patent is extended or adjusted under 35 U.S.C. 154(b) by 0 days.

(21) Appl. No.: 10/646,074

(22) Filed: Aug. 22, 2003

(65) Prior Publication Data

US 2004/0035884 A1 Feb. 26, 2004

Related U.S. Application Data

(63) Continuation-in-part of application No. PCT/US01/44404, filed on Nov. 26, 2001.

(60) Provisional application No. 60/429,096, filed on Nov. 26, 2002, provisional application No. 60/479,409, filed on Jun. 18, 2003.

(51) Int. Cl.
*B65D 51/00* (2006.01)

(52) U.S. Cl. ..... 222/209; 222/400.8; 222/401

(58) Field of Classification Search ..... 222/209, 222/400.8, 401
See application file for complete search history.

(56) References Cited

U.S. PATENT DOCUMENTS

| | | | | | |
|---|---|---|---|---|---|
| 69,485 | A | * | 10/1867 | Robbins | 222/209 |
| 280,798 | A | | 7/1883 | Colcord | |
| 301,767 | A | * | 7/1884 | Stark | 222/209 |
| 483,690 | A | | 10/1892 | Jones | |
| 718,163 | A | | 1/1903 | Sherrard | |
| 745,876 | A | | 12/1903 | Medley | |
| 1,106,937 | A | | 8/1914 | Goff | |
| 1,328,866 | A | * | 1/1920 | Yeatter | 222/400.8 |
| 1,445,643 | A | | 2/1923 | Peron | |
| 1,460,208 | A | | 6/1923 | Mohn | |
| 1,515,127 | A | | 11/1924 | Levinthal | |
| 1,679,104 | A | | 7/1928 | Trautman | |
| 1,776,489 | A | * | 9/1930 | Cobb | 222/209 |
| 1,852,685 | A | | 4/1932 | Tremblay | |
| 2,548,487 | A | * | 4/1951 | Marchant et al. | 222/633 |
| 3,105,619 | A | | 10/1963 | Rohrmuller | 222/209 |
| 3,430,817 | A | | 3/1969 | Falkenberg | 222/173 |
| 4,313,569 | A | * | 2/1982 | Burke | 222/380 |
| 4,347,953 | A | | 9/1982 | Bauer | 222/207 |
| 4,606,477 | A | | 8/1986 | Spengler et al. | 222/153 |
| 4,640,426 | A | | 2/1987 | Wasley | 215/228 |
| 4,763,818 | A | | 8/1988 | Stefano et al. | 222/209 |
| 4,899,896 | A | | 2/1990 | Metzger | 215/228 |
| 5,009,635 | A | | 4/1991 | Scarberry | 604/27 |
| 5,394,789 | A | | 3/1995 | Evans et al. | 99/345 |
| 5,405,060 | A | | 4/1995 | von Schuckmann | 222/325 |
| 5,623,974 | A | | 4/1997 | Losenno et al. | 141/20 |
| 5,638,994 | A | | 6/1997 | Libit et al. | 222/207 |
| 5,738,254 | A | | 4/1998 | de la Guardia | 222/400.8 |
| 6,371,322 | B1 | | 4/2002 | Bryant | 220/23.86 |
| 6,616,067 | B1 | * | 9/2003 | Hunter | 222/209 |
| 2004/0035884 | A1 | * | 2/2004 | de la Guardia | 222/207 |

* cited by examiner

*Primary Examiner*—Eric Keasel
(74) *Attorney, Agent, or Firm*—Monica Winghart; Patrick Bengtsson

(57) ABSTRACT

A pressurizing beverage dispenser removably attaches to the threaded neck of a container and includes a main body having a handle portion and a head portion. A valve spout on the head portion is moveable between a closed position and an open position. A hand operated squeeze bulb pump fitted to the handle delivers air through the discharge opening and pressurizes the container interior when the valve spout is closed. The handle portion can be structured and disposed to hold the squeeze bulb in a manner which prevents undesirable movement of the squeeze bulb and blockage of airflow to the container.

66 Claims, 29 Drawing Sheets

FIG. 18
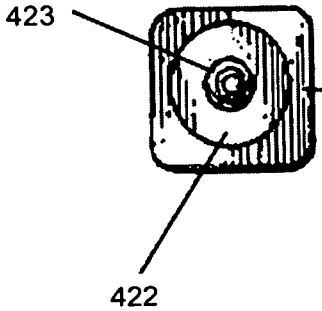
FIG. 19
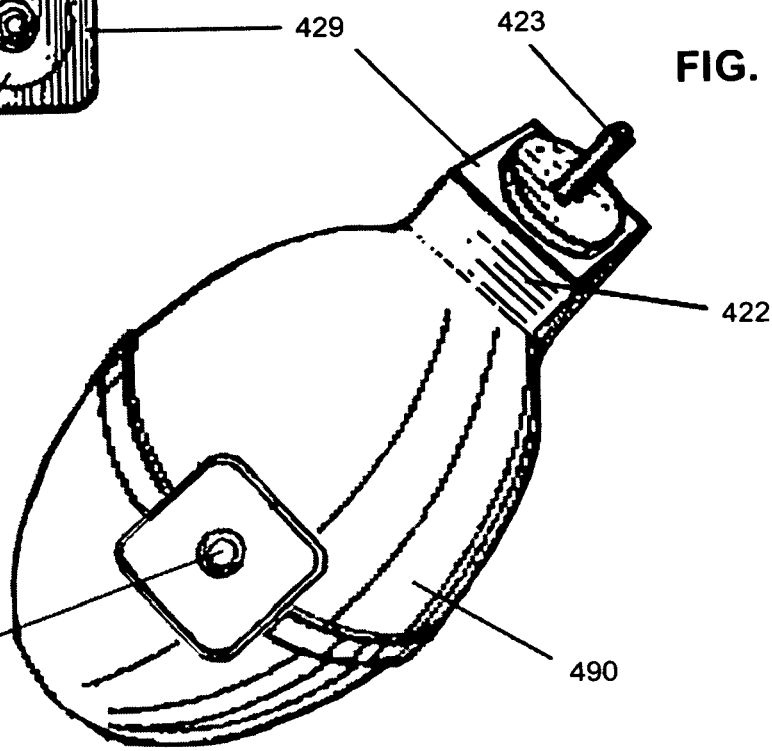
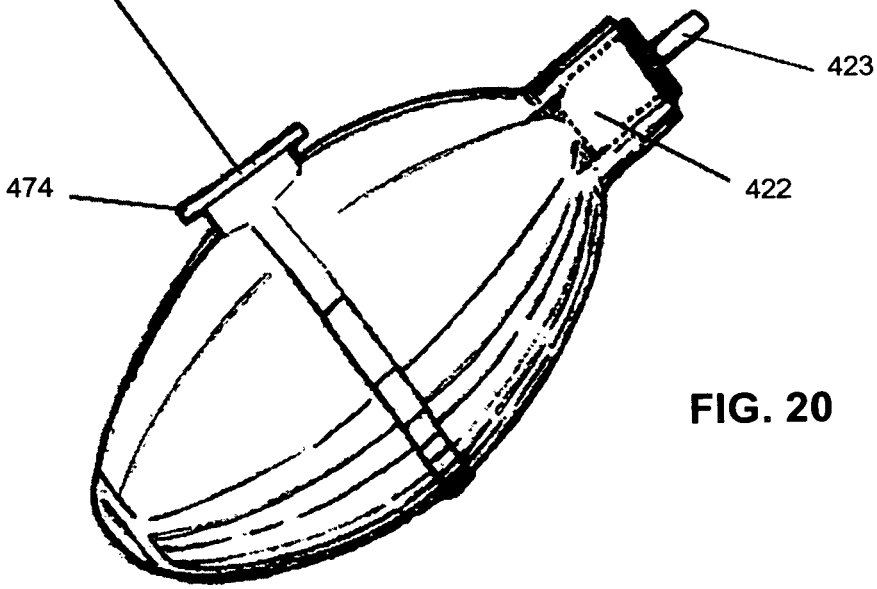
FIG. 20

FIG. 21
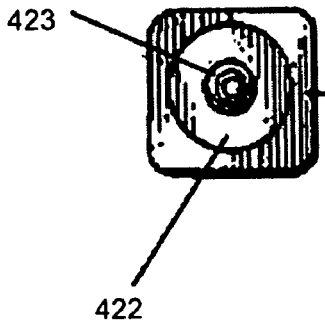
FIG. 22
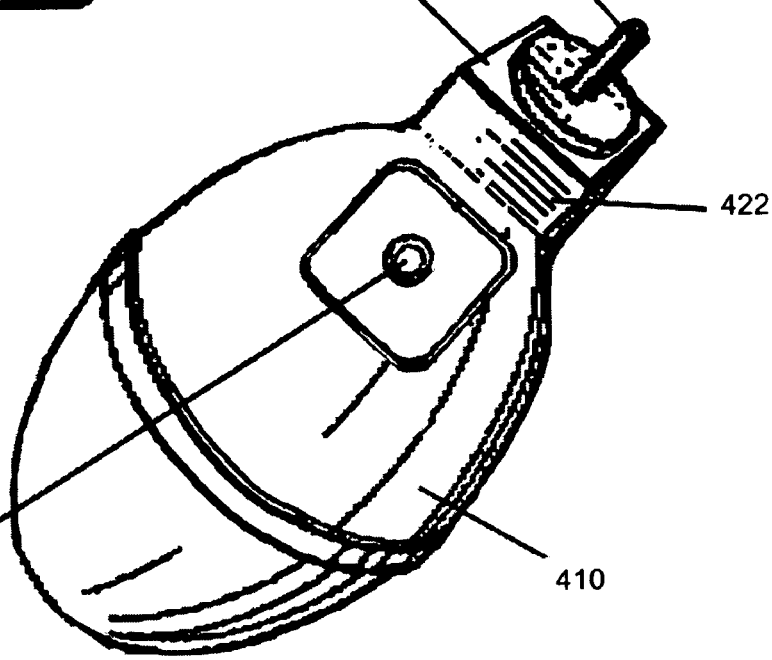
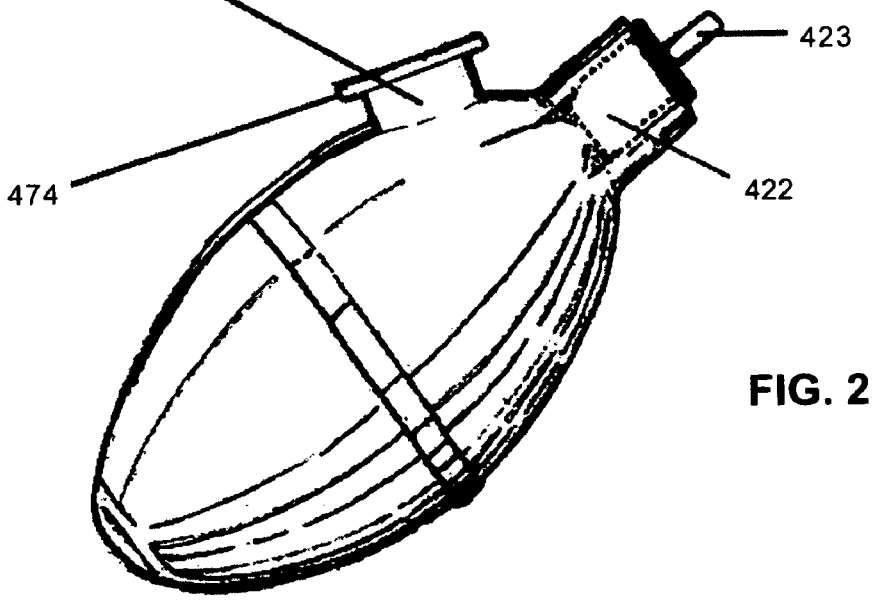
FIG. 23

FIG. 24
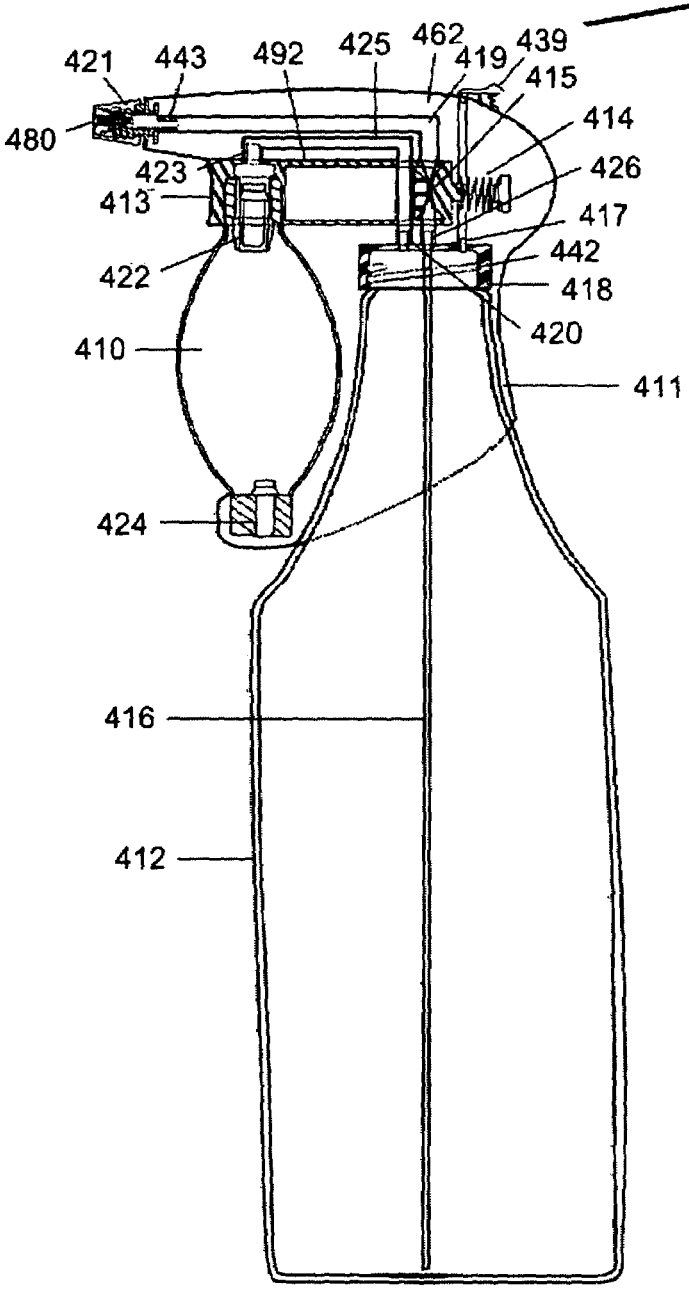
FIG. 25
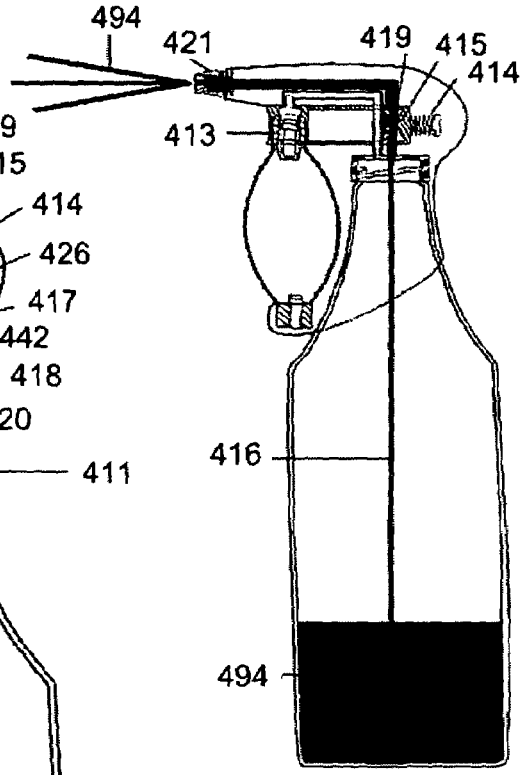
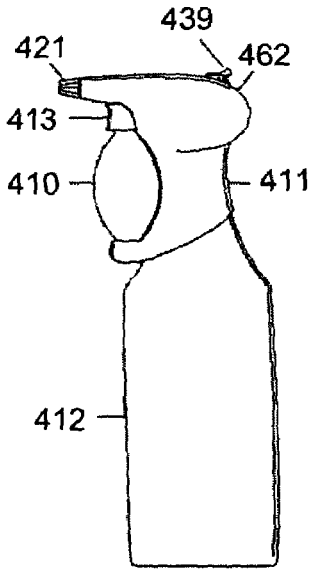
FIG. 26

FIG. 31
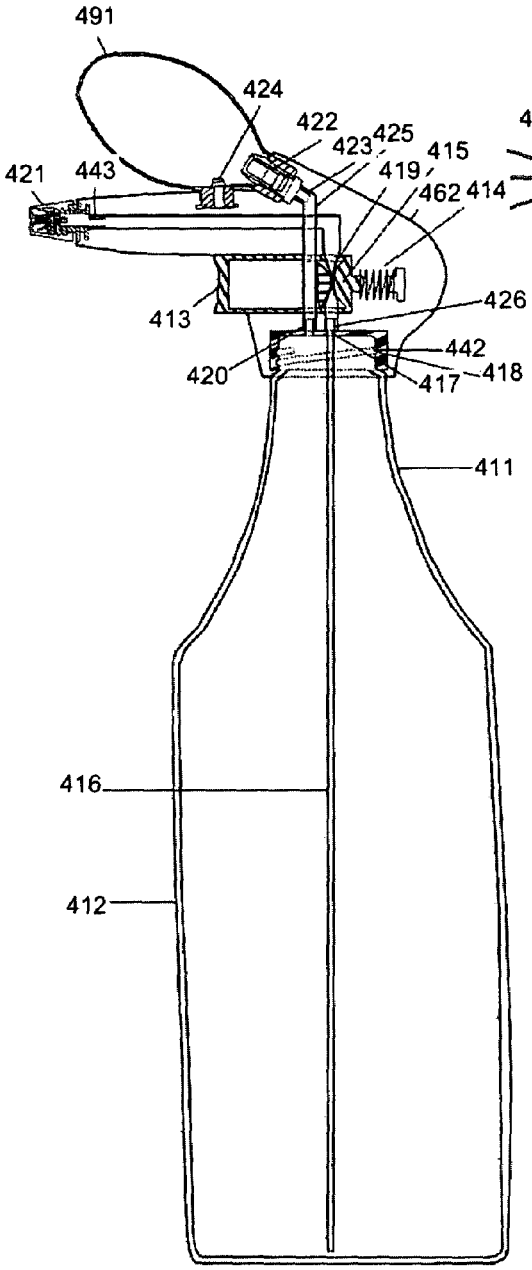
FIG. 32
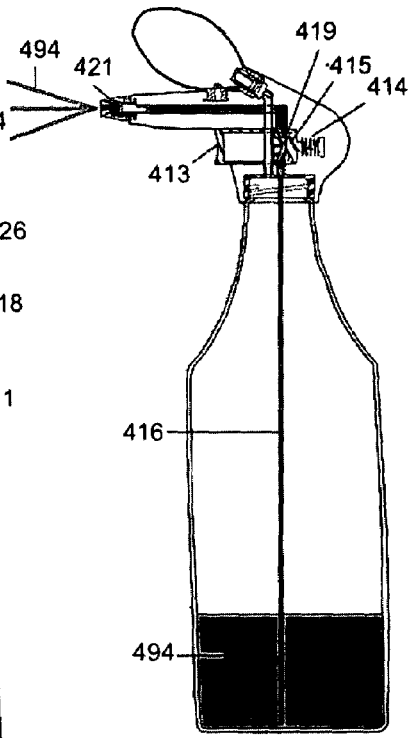
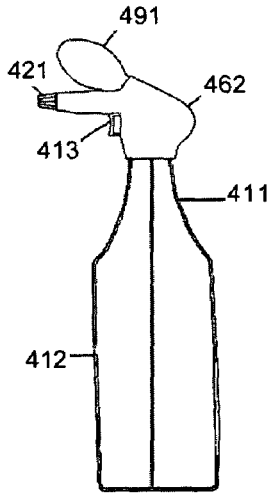
FIG. 33

FIG. 40
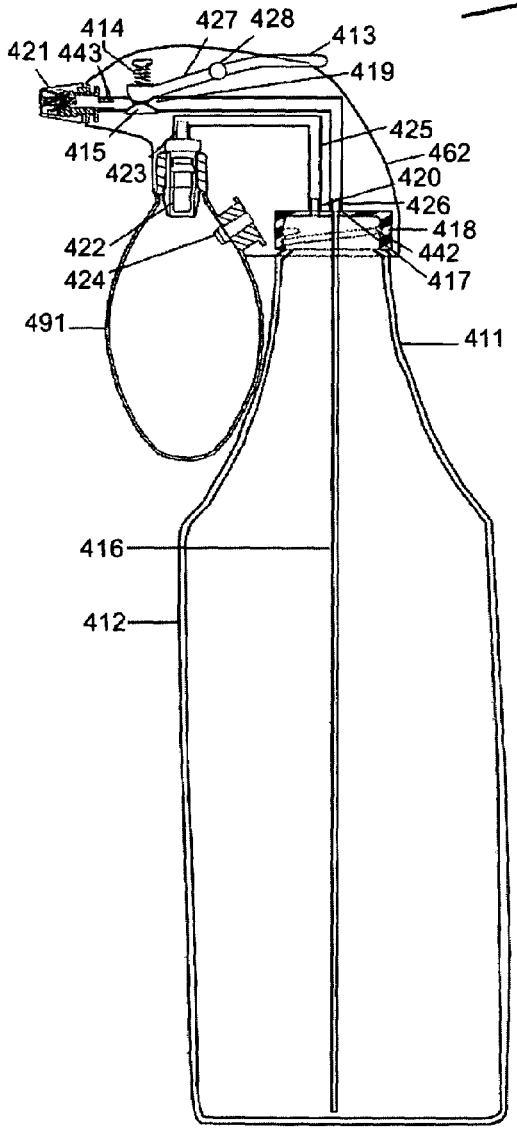
FIG. 41
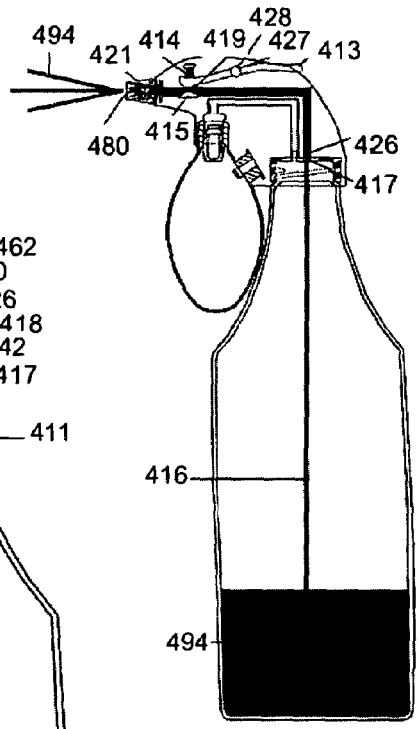
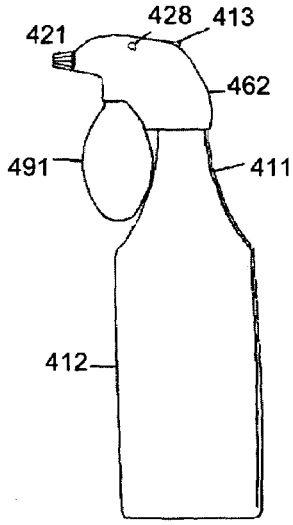
FIG. 42

PRESSURIZING DEVICE FOR ATTACHMENT TO FLUID CONTAINERS

RELATED APPLICATIONS

This patent application is a continuation in part of co-pending PCT patent application number PCT/US01/44404 having a filing date of Nov. 26, 2001. This patent application also claims priority from provisional patent application No. 60/429,096 having a filing date of Nov. 26, 2002. This patent application also claims priority from provisional patent application No. 60/479,409 having a filing date of Jun. 18, 2003.

FIELD OF THE INVENTION

This invention relates to pressurizing devices for fluid containers, and particularly to a pressurizing dispenser device adapted for removable or permanent attachment to a fluid container.

DISCUSSION OF THE RELATED ART

Many beverages, and particularly soft drinks, are impregnated with carbon dioxide gas in order to provide a refreshing effervescence which has a pleasant appeal when consuming the beverage. Often carbonated beverages are sold in two or three liter beverage containers in order to reduce the cost per ounce to the consumer. Many people find these larger size beverage containers to be more economical and convenient compared to cans because they can be recapped and stored if the beverage is not entirely consumed after the bottle is initially opened.

Notwithstanding, larger size carbonated beverage containers do present some problems to the user. In particular, it is well known that the carbonation has a tendency to escape into the atmosphere if the beverage is not contained under pressure. Because a closed beverage bottle, when half full, contains a large sealed open air space, the gas in the beverage is able to escape into this open space even when the cap is tightly secured to the bottle. Once the cap is removed, the carbonation gas in this space releases into the atmosphere. When carbon dioxide gas escapes from a carbonated beverage, the desirable sparkling effervescence is lost and cannot be replaced. Once this happens, the carbonated beverage become flat, leaving an undesirable taste with no refreshing appeal to the consumer. In this instance, the carbonated beverage will most likely be discarded or thrown away, thereby effectively increasing the cost per used ounce to the consumer. This certainly defeats the primary purpose of purchasing carbonated beverages in larger containers, which is to provide a greater volume of product to the consumer at a lower cost per ounce.

Additionally, it would be desirable to pressurize containers containing other types of fluid without requiring the use of toxic and dangerous (e.g., flammable) propellants. For example, many types of cleaning solutions are sold in a bottle having a trigger-pump type sprayer. To apply the fluid using a trigger-pump type sprayer, the user typically aims the bottle at the surface to be cleaned and pumps several blasts of cleaning solution onto the dirty surface. However, the area that is actually wetted by the cleaning solution is limited only to those areas wetted by the blasts. Other areas remain substantially dry until a cloth or sponge is used to spread the solution around. The result is that the areas receiving the initial blasts are thoroughly cleaned, but other areas may not receive enough of the cleaning solution to be effectively cleaned. It would be desirable to provide a continuous stream of a cleaning fluid so that all areas of a dirty surface are wetted by the solution without requiring the use of toxic and dangerous (e.g., flammable) propellants.

The same holds true for other types of fluids, such as cooking oils, paints, etc.

Pumping devices have been proposed for pressurizing the open volume within a carbonated beverage bottle with ambient air. It is also known to combine a closure cap and pressurizing pump for insertion in the neck of a container. U.S. Pat. No. 718,163 to Sherrard (1903) discloses a bottle tap for corked bottles. Air pressure is created in order to facilitate the discharge of the liquid therefrom. U.S. Pat. No. 2,853,207 to Yingst (1954) discloses a device for dispensing liquids. Both Sherrard's invention and Yingst's invention function to dispense a liquid from a bottle through a narrow tube which is inserted into the bottle.

The Ballas U.S. Pat. No. 4,768,665, discloses a hand operated pump which uses a cylinder and piston. The Ballas pump is attachable to a threaded bottle neck. Likewise, U.S. Pat. No. 4,723,670 to Robinson discloses a hand operated pump which attaches to a threaded bottle neck and which uses a cylinder and piston.

My prior invention, as described in U.S. Pat. No. 5,738,254, addresses many shortcomings of the prior art devices. Notwithstanding, I have conceived of several improvements which eliminate potential problems that may occur in the use of my prior invention. Specifically, the upper end of the squeeze bulb has been specifically structured and configured to provide a multi-sided surface for congruent, keyed engagement within notched cut-outs of the handle to prevent spinning or rotation of the squeeze bulb relative to the handle. Spinning or rotational movement of the squeeze bulb relative to the handle is not desirable because it results in twisting and kinking of the flexible hose which delivers air to the bottle interior. Further, the present invention provides for an improved airtight seal between the ball-shaped member of the valve spout and the valve seat. Accordingly, my present invention provides for improvements to the structure and function of my earlier invention along with new embodiments.

SUMMARY OF THE INVENTION

One embodiment of the present invention is directed to a pressurizing beverage dispenser which removably attaches to the threaded neck of a carbonated beverage container. The dispenser includes a main body which is molded to include an integral handle portion and head portion. A seal mechanism within the head portion provide an air and liquid tight seal between the dispenser device and the discharge opening of the beverage container and include a cap and a valve assembly. The cap is fitted within the head portion and includes interior threads for threaded engagement and attachment to the threaded neck of the beverage container. A central opening through the top of the cap aligns with the discharge opening of the container. The valve assembly includes a pivotal valve spout on the head portion which is moveable between a closed position and an open position. A ball-shaped portion of the valve spout is disposed in mating, sealing engagement with a dish-shaped valve seat. The valve seat is preferably formed of an elastomeric, resilient material such as silicone. An opening in the dish-shaped valve seat aligns with the central opening of the cap and the discharge opening of the beverage container. When the pivotal valve spout is in the closed position, the ball-shaped portion is disposed in blocking, sealing relation to the central opening and discharge opening so that gas and fluid are contained within the beverage container. Movement of the valve spout to the open position serves to rotate the ball-shaped portion relative to the valve seat until a bore formed through the valve spout, defining a fluid passage, aligns with the central opening of the cap, thereby permitting the beverage contents of the container to be poured from the valve spout.

A pressurizing mechanism is provided for pressurizing the air space of the container after moving the valve spout from the open position to the closed, sealed position. The pressurizing mechanism includes a hand-operated squeeze bulb pump fitted to the handle portion. The squeeze bulb has a central hollow body surrounding a compressible interior air chamber, a first end portion and a second end portion. The first end portion of the squeeze bulb is fitted with a one-directional air intake valve member which is structured and disposed to draw air into the compressible interior chamber of the squeeze bulb as the central hollow body is released from the compressed state and returned to a normally relaxed, full shape. The second end portion of the squeeze bulb is fitted with a one-directional air exhaust valve member which directs air outwardly from the squeeze bulb interior chamber upon compressing the hollow body. A flexible hose connects between the exhaust valve member on the squeeze bulb and the seal mechanism in the head portion, in air flow communication with the interior air space of the beverage container. A mechanism is provided for preventing rotation of the squeeze bulb relative to the handle portion. This prevents the flexible hose from becoming twisted and kinked, which would result in blockage of airflow between the squeeze bulb interior air chamber and the air space within the beverage container interior.

When the dispenser device of the present invention is threadably fastened to the neck of the beverage container, a charge of air is introduced into the bottle interior by repeatedly squeezing and releasing the hand operated squeeze bulb pump on the handle portion until the interior air space within the container is fully pressurized. The fully pressurized condition will be realized when there is increased resistance in compressing the squeeze bulb pump. Mating engagement of the ball-shaped portion of the valve spout against the valve seat provides an air and liquid tight seal, holding the air pressure and liquid contents within the beverage container. A integral lever extending from the valve spout facilitates ease of movement of the valve between the closed and open positions. When the valve spout is moved to the open position, the charge of pressurized air is released from the bottle. While maintaining the valve spout in the open position, the carbonated beverage within the container may be poured by tilting the container so that the neck is angled downwardly, thus allowing the beverage contents to flow through the passage of the valve spout and into a glass or other drinking vessel.

Yet another embodiment of the present invention is directed to a portable manual sprayer which may be interconnected and integrally formed to a pump handle that is attachable to a container such as a bottle. Squeezing the pump handle will direct air into the bottle of the sprayer. A trigger may be fixed to one of two points to include the bottom or top portion of the handle. The trigger is connected to a valve. The pump handle has an air tube connected to a bottle of the sprayer. The bottle of the sprayer has an internal tube that is indirectly connected to the valve. Pressing the trigger will open the valve allowing the liquid to flow out of the spray nozzle. Releasing or depressing the trigger will close the valve. A spray volume control is located on the nozzle for selection between mist and stream. The pump handle may include a bulb style air pump that is partially exposed and firmly secured within an ambidextrous handle in a way as to prevent the pump from rotating or spinning thereby avoiding blockage or kinking of the air tube through which air is pumped into the container. One clear advantage of the pump handle is that a user can pump air, spray liquid, hold and maintain manual control of the sprayer all at the same time, with the use of one hand.

The pump handle can serve a multitude of uses. The pump handle can be interconnected and formed integrally for use with many host devices. These devices would include any device that requires a handle and air to flow into the device. The pump handle can also be interconnected and formed integrally for use with devices which require a handle and air to flow into the device with a trigger fitted to perform a specific task or action such as closing and opening a valve. Other attributes of the pump handle sprayer include an ambidextrous handle, pump and trigger; a precise and directional spray control; relatively few pumps will dispense several ounces of liquid; and a compact and portable but yet fairly simple design. Few parts make it highly reliable and simple to produce and manufacture.

In addition, the pump handle equipped sprayer may be pressurized in advance of use by pumping the air pump. Then the user only needs to press the trigger of the pressurized sprayer to dispense liquid. This function would be suitable for barber shops and the like, to spray water on hair. The barber would pressurize the sprayer in advance of a customer being seated by pumping the handle a few times. When it is time for use, the barber needs only to hold the sprayer by the handle and depress the trigger for continuous spray or mist without the need to pump repeatedly.

The pump handle equipped sprayer is well suited for spraying chemicals like cleaning solutions, weed killers, insecticides, etc. With the spray nozzle on one end and the handle on the opposing far end, there is less chance of the hand coming into contact with hazardous chemicals being sprayed. Since the pump sprayer requires relatively low number of pumps, the risk for a repetitive work injury is diminished. Further, the pump handle can be attached to the container to create a disposable unit that cannot be opened without damage to the unit, thereby rendering the unit relatively spill-proof and child-proof. These health and safety features give the pump sprayer a plethora of commercial uses.

Funnels are often used to refill conventional sprayers. Conventional sprayers are constructed with the handle incorporated into the neck of the bottle; this restricts the diameter of the bottle neck rim to a relatively small size. A bottle neck rim with a larger diameter is desirable because the need for a funnel is eliminated. Since the handle of the pump handle sprayer is located on the outside of the bottle, there are no restrictions to the diameter size of the bottle neck rim.

The pump handle may also be interconnected and formed integral with other devices including a toy water pistol. The water tank of the water pistol is filled with water, and then squeezing the handle a few times will result in pressurization of the water tank. To spray the water, the trigger is pressed. When the trigger is released the water stops spraying. One novel feature of the water pistol pump handle is that the user may pump, spray, and hold the device with only one hand. Conventional water pistols require the use of both hands, one hand to hold the handle and the second hand to pump a piston pump. A user may hold two water pistols, one in each hand, while pumping and spraying simultaneously.

BRIEF DESCRIPTION OF THE DRAWINGS

For a fuller understanding of the nature of the present invention, reference should be made to the following detailed description taken in conjunction with the accompanying drawings in which:

FIG. 18 is a front top plan of the cube shaped end of a bulb air pump showing an exhaust check valve.

FIG. 19 is a front top perspective view showing a bulb air pump with cube shaped top with an exhaust check valve located at the top portion and an intake check valve located on the side perpendicular to the exhaust valve.

FIG. 20 is a side perspective view showing a bulb air pump with cube shaped top with an exhaust check valve located at the top portion and an intake check valve located on the side perpendicular to the exhaust valve.

FIG. 21 is a front top plan of the cube shaped end of a bulb air pump showing an exhaust check valve.

FIG. 22 is a front top perspective view showing a bulb air pump with cube shaped top and an exhaust check valve located at the top portion and an intake check valve located towards the top corner section adjacent the exhaust valve.

FIG. 23 is a side perspective view showing a bulb air pump with cube shaped top with an exhaust check valve located at the top portion and an intake check valve located towards the top corner section adjacent the exhaust valve.

FIG. 24 is a side view, in section, showing a bottle in combination with a pump sprayer interconnected to a conventional bulb style air pump that is attached within a full handle housing structure, showing the pump and trigger located towards the bottom corner portion of the sprayer, with the valve in the closed position.

FIG. 25 is a side view, in section, showing a bottle in combination with a pump sprayer interconnected to a conventional bulb style air pump that is attached within a full handle housing structure, showing the pump and trigger located towards the bottom front corner portion of the sprayer, with the valve in the open position.

FIG. 26 is a side exterior view showing a bottle in combination with a pump sprayer with the pump and trigger located towards the bottom front corner portion and directly in front of a full handle housing structure.

FIG. 31 is a side view, in section, showing a bottle in combination with a pump sprayer interconnected to a collapsible air pump with intake valve located towards the exhaust or top portion of the pump adjacent to the exhaust valve, showing the pump located towards the top front corner portion of the sprayer and the trigger located towards the bottom front corner with the bottle forming the handle, the valve is in the closed position.

FIG. 32 is a side view, in section, showing a bottle in combination with a pump sprayer interconnected to a collapsible air pump with intake valve located towards the exhaust or top portion of the pump adjacent to the exhaust valve, showing the pump located towards the top front corner portion of the sprayer and the trigger located towards the bottom front corner with the bottle forming the handle, the valve is in the open position.

FIG. 33 is a side exterior view showing a bottle in combination with a pump sprayer showing the pump located towards the front top corner and the trigger located towards the bottom front corner portion of the sprayer with the bottle forming the handle.

FIG. 40 is a side view, in section, showing a bottle in combination with a pump sprayer interconnected to a collapsible air pump with intake check valve on the top corner adjacent to the exhaust valve, showing the pump located towards the bottom front corner portion of the sprayer and the trigger located towards the top back corner with the bottle forming the handle, the valve is in the closed position.

FIG. 41 is a side view, in section, showing a bottle in combination with a pump sprayer interconnected to a collapsible air pump with intake check valve on the top corner adjacent to the exhaust valve, showing the pump located towards the bottom front corner portion of the sprayer and the trigger located towards the top back corner with the bottle forming the handle, the valve is in the open position.

FIG. 42 is a side exterior view showing a bottle in combination with a pump sprayer showing the pump located towards the bottom front corner and the trigger located towards the top back corner portion of the sprayer with the bottle forming the handle.

Like reference numerals generally refer to like parts throughout the several views of the drawings. The drawings are not necessarily to scale and the proportions of certain parts have been exaggerated to better illustrate operation of the invention.

DETAILED DESCRIPTION OF THE PREFERRED EMBODIMENTS

The following description is the best mode presently contemplated for carrying out the present invention. This description is made for the purpose of illustrating the general principles of the present invention and is not meant to limit the inventive concepts claimed herein.

Referring to the several views of the drawings, a pressurizing beverage dispenser device according to one embodiment is shown and is generally indicated as 10. The device 10 is particularly suited for attachment to a bottle B containing a carbonated beverage, such as a soft drink product. The pressurizing beverage dispenser device 10 removably attaches to the threaded neck N of the carbonated beverage container. The device 10 is particularly suited for use on two-liter and three-liter carbonated beverage containers, of the type shown in FIGS. 1 and 2 and indicated as B. Beverage containers of this nature are known to include a threaded neck which terminates at a discharge opening surrounded by a top rim. A cap is normally screwed on to the threaded neck to cover the discharge opening in order to preserve the beverage contents therein. When the beverage is consumed, the cap is removed so that the carbonated beverage contents can be poured from the discharge opening and into a glass or other drinking vessel.

Figure 5:
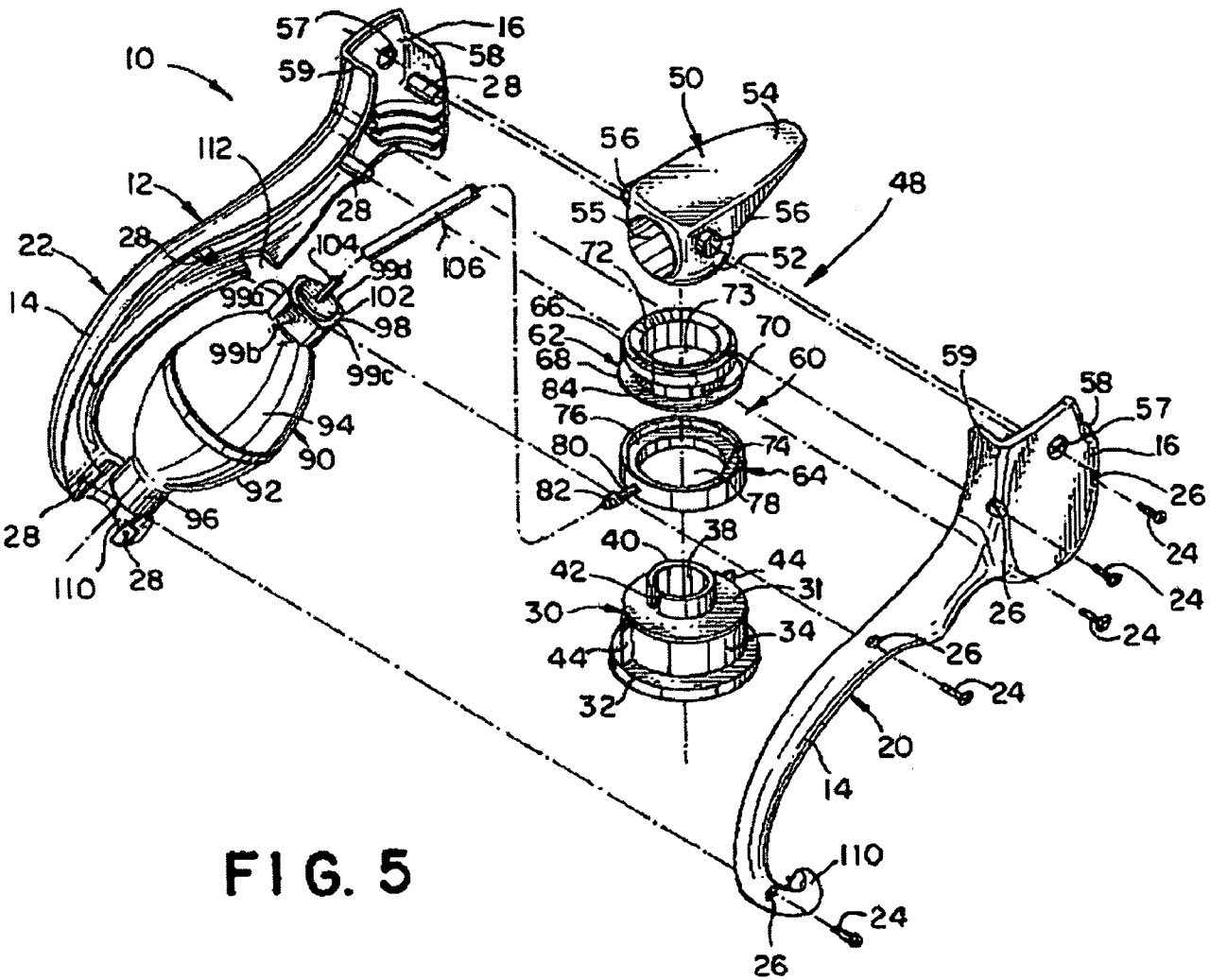
FIG. 5 is an exploded perspective view of the pressurizing beverage dispenser device showing the individual component elements thereof.

The pressurizing beverage dispenser device of the present invention removably attaches to the threaded neck N of the carbonated beverage container and replaces the conventional cap which is fastened to the neck N of the bottle B when the beverage product is purchased. The device 10 includes a main body 12 which is molded to include an integral handle portion 14 and a head portion 16. In a preferred embodiment, the main body 12 is formed of a plastic composition and is molded as a two-piece structure, including a first half 20 and a second half 22. The two halves 20, 22, mate together, as illustrated in FIG. 5, to form the integral handle portion 14 and head portion 16 as well as to contain the remaining component elements of the device. Screws 24 can be used to secure the two halves 20, 22 together. The screws pass through apertures 26 formed through the first half 20 and into threaded engagement with aligned threaded bosses 28 on the interfacing side of the second half 22 of the main body 12.

When the beverage container B is initially opened, after purchase, by removing the conventional cap from the threaded neck N, the conventional cap is discarded and the device 10 is fastened to the threaded neck N. A seal mechanism within the head portion 16 provide an air and liquid tight seal between the dispenser device 10 and the discharge opening of the beverage container B in order to contain and preserve the beverage contents therein. The seal mechanism includes a cap 30 and a valve assembly 48. The cap 30 is fitted within the head portion and includes interior threads 36 for threaded engagement and attachment to the threaded neck N of the beverage container B until the top rim of the beverage container neck surrounding the discharge opening mates against an inner cap end surface 37. A central opening 38 through the top of the cap aligns with the discharge opening of the beverage container B. An annular ring 40 is formed on the top of the cap, surrounding the central opening 38, and is provided with a slotted opening 42. Wing members 44 are provided on opposite sides of an annular collar 34 of the cap, extending upwardly from a base flange 32. The wing members 44 are specifically structured to prevent rotation of the cap relative to the main body 12 when the cap 30 is threadably secured to the neck N of the beverage container B to effectively secure the device 10 to the beverage container B.

As seen in FIG. 5, the entire valve assembly 48, including the cap 30 is held within the head portion 16 of the device 10 between the two halves 20, 22.

Figure 1:
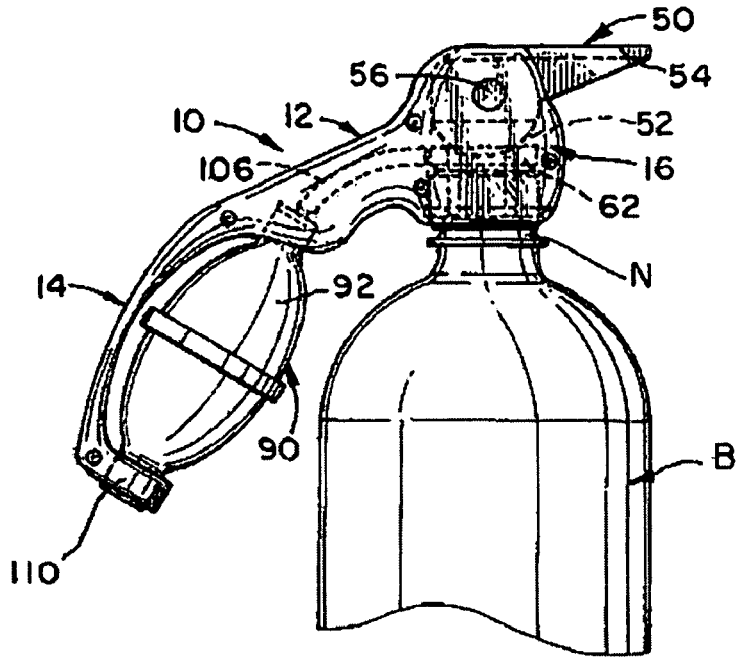
FIG. 1 is a partial side elevational view showing the pressurizing beverage dispenser device of the present invention secured to the threaded neck of a beverage container with the valve spout of the device in a closed, sealing position.
Figure 2:
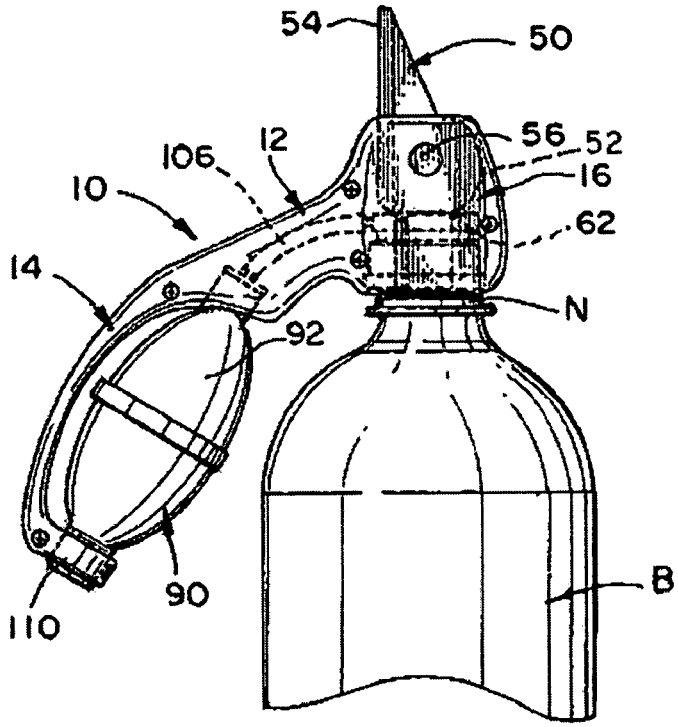
FIG. 2 is a partial side elevational view showing the pressurizing beverage dispenser device of the present invention secured to the top neck of the beverage container with the valve spout in an open position, thereby enabling the beverage contents to be poured from the container.

The valve assembly 48 further includes a pivotal valve spout 50 moveably secured to the head portion and operable between a closed, sealed position and an open position. The pivotal valve spout 50 is defined primarily by a ball-shaped portion 52 and a lever 54 extending outwardly from the top half of the ball-shaped portion 52. A fluid flow passage 55 is formed through the ball-shaped portion 52 and is specifically structured and disposed for permitting flow of the beverage contents of the bottle B therethrough when pouring the beverage product from the bottle. Hinge stubs 56 on opposite sides of the ball-shaped portion 52 are structured and disposed for captivated, freely rotatable receipt within correspondingly aligned apertures 57 on the first and second halves 20, 22 of the head portion 16. Receipt of the hinge stubs 56 within the apertures 57 serves to secure the valve spout 50 to the head portion 16, while providing for selective, pivotal movement of the valve spout 50 between the closed, sealed position, as seen in FIG. 1, and the open position as seen in FIG. 2. The extending lever portion 54 facilitates ease of movement between the closed, sealed position and the open position. A front lip 58 on the head portion 16 provides a stop member to limit downward movement of the valve spout at the closed, sealed position. Similarly, a back edge 59 on the head portion 16 provides a stop member to limit movement of the valve spout 50 at the fully open position, as seen in FIG. 2.

The valve assembly 48 further includes a seal assembly 60 for maintaining an air tight and liquid tight seal between the valve spout 50 and the central opening 38 of the cap 30 in order to contain the beverage within the bottle B and to maintain the pressurized state of the air space within the bottle B when the valve spout 50 is in the closed position. The seal assembly 60 is comprised of a two-piece structure, including a flexible resilient seal member 62 and a rigid ring member 64. In a preferred embodiment, the flexible resilient seal member 62 is formed of an elastomeric composition, such as silicon. The rigid ring member 64 may be formed of a rigid plastic composition similar to that of the cap 30. The flexible resilient seal member 62 includes an upper portion 66, a lower portion 68 and a neck 70 defined by a section of reduced diameter extending between the upper and lower portions. A dish-shaped concave annular surface 72 is formed on the upper portion 66 in surrounding relation to an opening 73. The dish-shaped concave portion 72 defines a valve seat for mating engagement with the ball-shaped portion 52 of the valve spout 50. The flexible resilient seal member 62 is fitted to the rigid ring member 64 during assembly of the device 10. Specifically, the lower portion 68 of the seal member 62 is passed through an opening 78 of the ring member 64. The opening 78 is surrounded by an inner rim 74 having a top rim surface 76. When the seal member 62 is properly fitted to the ring member 64, the lower portion 68 of the seal member 62 is maintained below the inner rim 74 and the upper portion 66 of the seal member is maintained above the inner rim 74. The inner rim 74 surrounds the neck 70 of the seal member 72 so that an aperture 84 formed through the neck 70 aligns with an inner open end of a hollow stem 80 extending from the ring member 64. The hollow stem 80 includes an enlarged head 82 at the free distal end. The combined seal member 62 and rigid ring member 64 of the seal assembly 60 sits on the top of the cap 30 so that an underside of the lower portion 68 of the seal member 62 mates firmly with the top surface 31 of the cap 30, thereby providing an air and liquid tight seal between the seal assembly 60 and the cap 30. When the seal assembly 60 and cap 30 are properly positioned and secured within the head portion 16 between the two halves 20, 22, the slotted opening 42 aligns with the aperture 84 and hollow stem 80 to provide air flow communication between the open distal end at the enlarged head 82 of the hollow stem 80 and the central opening 38 of the cap which communicates with the discharge opening and interior of the beverage container B.

Figures 3, 4:
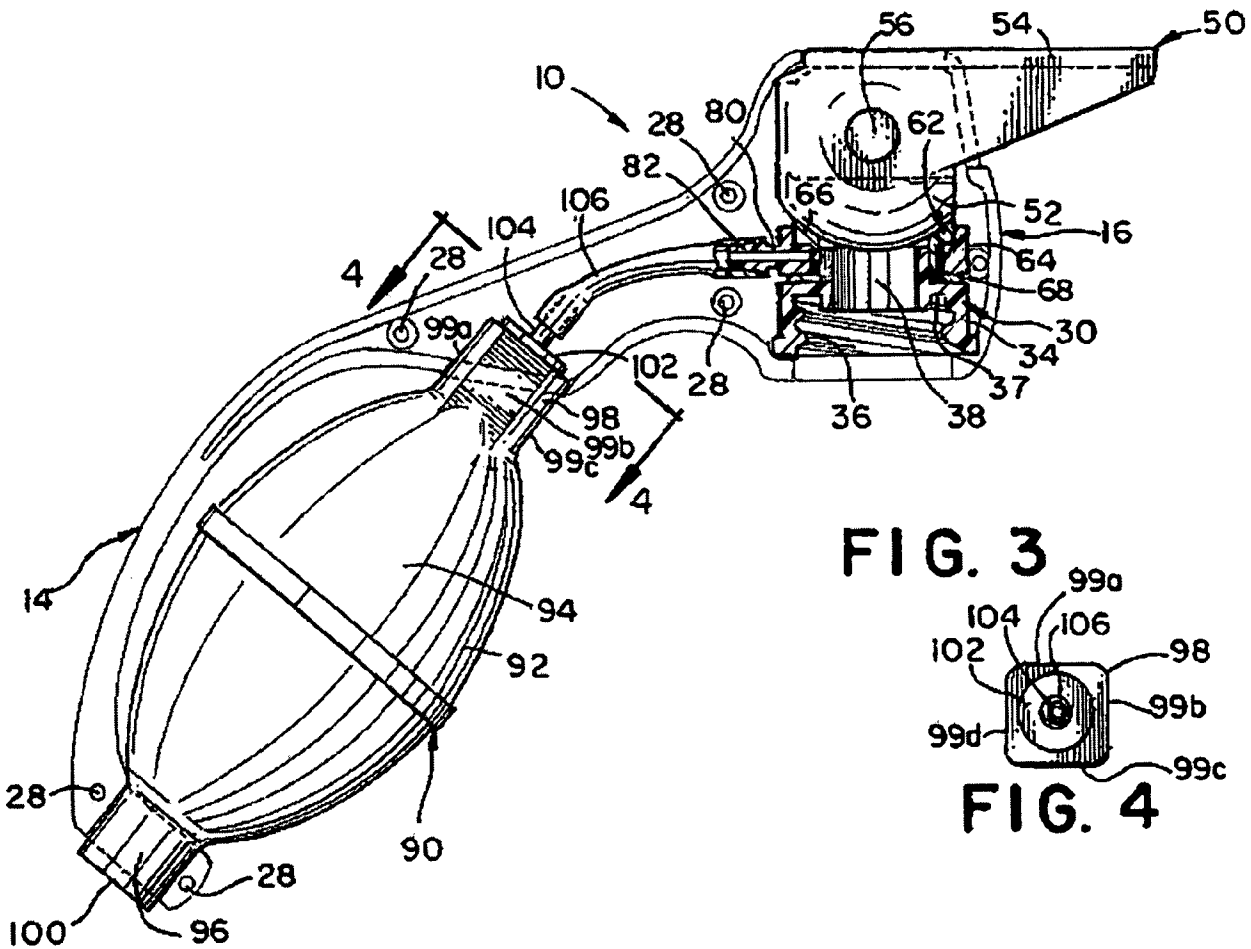
FIG. 3 is a side elevational view, in partial section, showing the pressurizing beverage dispenser device of the present invention, in accordance with a preferred embodiment thereof.
FIG. 4 is a top plan view of the end of the squeeze bulb pump of the device, taken from the view indicated by the hours 4—4 in FIG. 3.

An air pump mechanism 90 is provided for introducing air into the interior air space of the beverage container, between the surface of the liquid beverage and the discharge opening of the container B in order to pressurize the air space when the valve assembly 48 is in the closed, sealed position, thereby maintaining the carbonated gas within the liquid beverage. The air pump mechanism 90 includes a hand-operated squeeze bulb pump 92 secured to the handle portion 14. The squeeze bulb pump 92 includes a central hollow body 94 surrounding a compressible interior air chamber, a first end portion 96 and an opposite second end portion 98. The second end portion of the squeeze bulb pump is provided with a multi-sided outer surface for keyed receipt within congruent shaped notches 112 formed in the mating first and second halves 20, 22. In a preferred embodiment, the multi-sided outer surface of the second end portion includes four sides 99*a*, 99*b*, 99*c*, and 99*d* as best seen in FIG. 4. Specifically, the four sides 99*a*–99*d* are arranged to define a generally square configuration to the second end portion 98.

The first end portion 96 of the squeeze bulb pump 92 is fitted with a one-directional air intake valve member 100 which is structured and disposed to draw air into the compressible interior chamber of the squeeze bulb as the central hollow body is released from a compressed state and returned to a normally, relaxed full shape. The second end portion 98 of the squeeze bulb pump 92 is fitted with a one-directional air exhaust valve member 102 which directs air outwardly from the squeeze bulb interior chamber when compressing and collapsing the hollow body. A hollow needle stem 104 extends from the exhaust valve member 102 to facilitate connection of a flexible air hose 106 which extends between the exhaust valve member 102 and the hollow stem 80. More specifically, the needle stem 104 is received within one end of the flexible hose 106 while the enlarged head 82 of the hollow stem is inserted within the opposite end of the hose 106, so that the flexible hose 106 remains connected in airflow transfer relation between the exhaust valve member 102 and the hollow stem 80, thereby providing airflow communication between the compressible interior air chamber of the squeeze bulb pump and the interior air space within the beverage container B.

The keyed fitting of the multi-sided exterior surface configuration of the second end portion of the squeeze bulb pump within the congruently configured notches 112 in the handle portion prevent the squeeze bulb pump 92 from spinning or rotating relative to the handle portion 92 when operating the squeeze bulb pump. Specifically, upon compressing and releasing the body of the squeeze bulb pump, the opposite first and second end portions 96, 98 of the squeeze bulb pump remain stationary relative to the main body 12 of the device. Specifically, the keyed fitting of the second end portion 98 to the handle portion 14 prevents spinning or rotation of the squeeze bulb pump 92 relative to the handle portion 14, thereby preventing the flexible hose from becoming twisted and/or kinked during use of the device 10, which may otherwise result in blockage of airflow between the squeeze bulb pump and the air space within the beverage container interior. A collar 110 formed on the end of the handle portion 14 of each of the first and second halves 20, 22 surrounds and grasps the first end portion 96 of the squeeze bulb pump 92 to firmly secure the first end portion thereto. Accordingly, the squeeze bulb pump 92 is held as an integral component of the handle portion 14.

Alternative mechanisms for preventing rotation of the squeeze bulb include an adhesive, coupling to a rigid or semi-rigid tube, etc.

In use, the dispenser device 10 of the present invention is threadably fastened to the neck N of the beverage container B. With the valve spout 50 moved to the closed position, as shown in FIG. 1, a charge of air is introduced into the interior air space of the bottle B by repeatedly squeezing and releasing the hand-operated squeeze bulb pump 92 on the handle portion 14 until the air space within the container B is fully pressurized. The fully pressurized condition will be realized when there is increased resistance in compressing the squeeze bulb pump. Mating engagement of the ball-shaped portion 52 of the valve spout 50 against the valve seat 72 provides an air tight and liquid tight seal, holding the air pressure and liquid beverage contents within the beverage container B. When the valve spout is moved to the open position, as seen in FIG. 2, by grasping the lever portion 54 and lifting upwardly to rotate the valve spout approximately 90 degrees, the charge of pressurized air is released from the bottle B. While maintaining the valve spout in the open position, the carbonated beverage product within the container B may be poured by tilting the container so that the neck N is angled downwardly, thus allowing the beverage contents to flow through the passage 55 of the valve spout 50 and into a glass or other drinking vessel. After pouring the beverage, the valve spout 50 is again closed to seal the interior of the bottle and the hand-operated squeeze bulb pump is repeatedly squeezed and released to repressurize the bottle interior air space.

Figure 6:
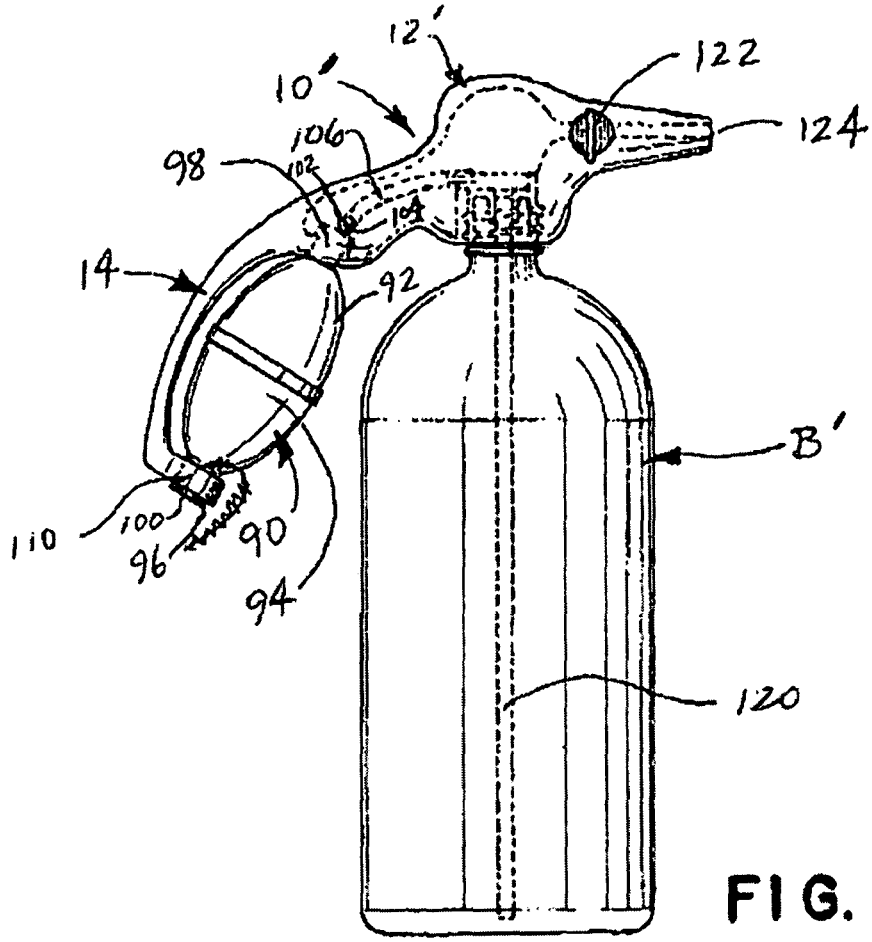
FIG. 6 is a side elevational view showing an alternative embodiment of the present invention wherein the handle portion and air pump mechanism are molded within an integral head portion of a siphon dispenser for dispensing a carbonated beverage from a bottle or other container.

Referring to FIG. 6, an alternative embodiment of the present invention is shown wherein the handle portion 14 and air pump mechanism 90 are incorporated within a siphon dispenser device 10'. In this embodiment, the handle portion 14 is integrally formed as part of a main body 12' having a mechanism for threadable attachment to the top of a carbonated beverage container B'. The handle portion 14 and air pump mechanism 90 are identical to that which was described in connection with the embodiment of FIGS. 1–5. Specifically, the air pump mechanism 90 includes a hand operated squeeze bulb pump 92 secured to the handle portion 14. The squeeze bulb pump 92 includes a central hollow body 94 surrounding a compressible interior air chamber, a first end portion 96 and an opposite second end portion 98. The first end portion 96 is fitted with a one-directional air intake valve member 100 and the second end portion 98 is fitted with a one-directional air exhaust valve member 102, the valve members 100, 102 functioning as described above. A hollow needle stem 104 extends from the exhaust valve member 102 to facilitate connection of a flexible air hose 106 which extends from the exhaust valve member 102 and connects for a fitting for air flow communication with the hollow interior of the beverage container B'. The collar 110 formed on the handle portion 14 surrounds and grasps the first end portion 96 of the squeeze bulb pump 92 to firmly secure the first end portion thereto. While not shown in FIG. 6, the second end portion 98 is keyed to the handle portion 14 in the same manner as described in connection with the embodiment of FIGS. 1–5, so that the squeeze bulb pump is unable to rotate relative to the handle portion 14, thereby preventing twisting and kinking of the flexible hose 106.

To operate the siphon device 10' of FIG. 6, the squeeze bulb pump 92 is compressed and relaxed through several cycles in order to introduce air, under pressure, into the interior air space of the beverage container B'. This serves to force the liquid contents upwardly through hollow tube 120 which has an open end disposed in close spaced relation to the bottom of the interior of the beverage container B'. The liquid beverage flows upwardly to valve member 122 which, when operated towards a fully open position, permits passage of the liquid beverage, under force, through the discharge opening 124.

Water Pistols

Figure 7:
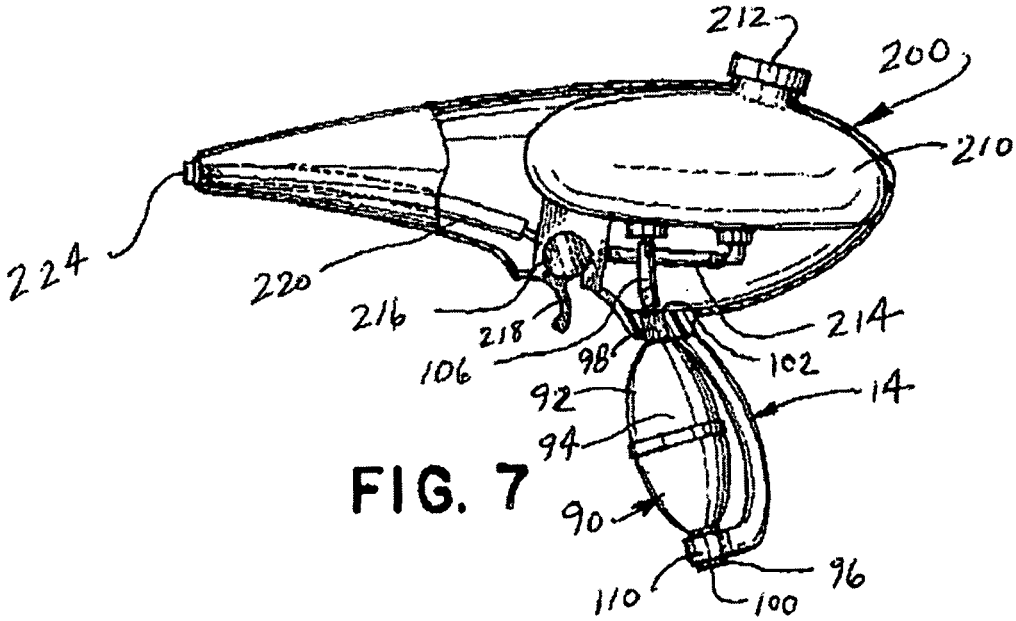
FIG. 7 is a side elevational view, in partial section, illustrating yet another embodiment of the present invention wherein the handle portion and air pump mechanism are incorporated within a water pistol with the trigger on the bottom of the handle.
Figure 8:
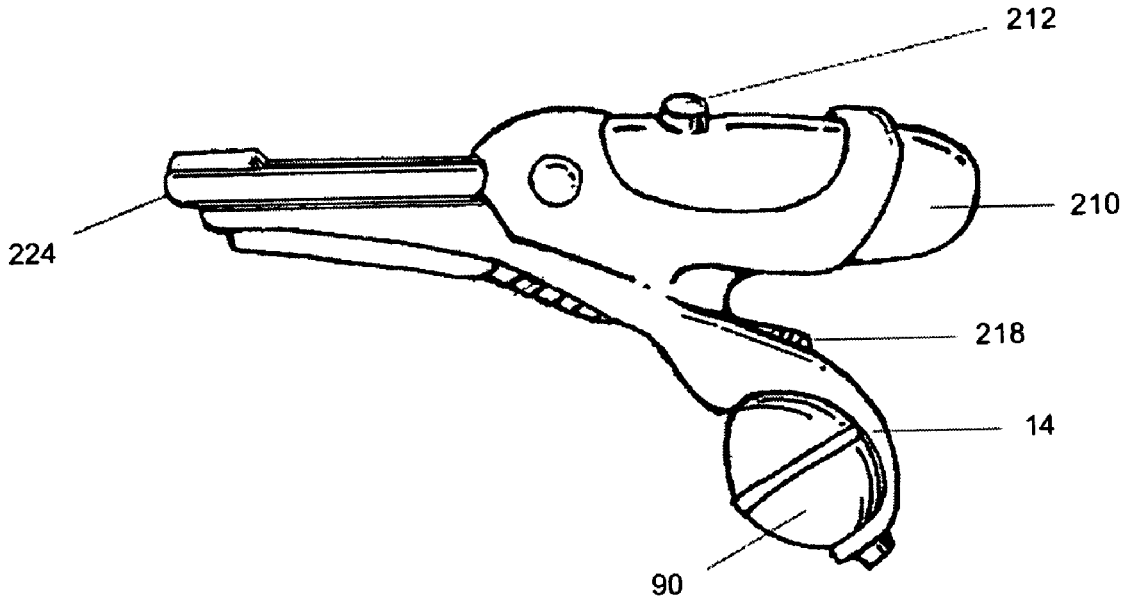
FIG. 8 is a side elevational view showing the pump handle in combination with a toy water pistol with the trigger on top of the handle.

FIGS. 7 and 8 illustrate yet another embodiment of the present invention, wherein the handle portion 14 and air pump mechanism 90 are incorporated within water pistols 200. The structure of the handle portion 14 and air pump mechanism 90 are similar to the above-described embodiments of FIGS. 1–6. In this particular embodiment, the handle portion 14 is integrally formed with the body of water pistol 200. The one-directional air exhaust valve member 102 on the second end portion 98 of the pump 92 connects with air hose 106. The opposite end of the air hose 106 is connected in airflow communication with water tank 210 which is filled with water by removing fill cap 212. In operation, the squeeze bulb pump 92 is operated by compressing and releasing the squeeze bulb to direct forced air into the water tank 210 through hose 106, thereby causing the air tank to become pressurized. A discharge hose or conduit 214 leads from the bottom of the water tank 210 to conduit 220 and is interrupted by a valve 216. The valve 216 is operable by a trigger 218 and is normally disposed in a relaxed, closed position, to block water flow from hose 214 to conduit 220. Upon operating the trigger 218 with the index finger or thumb, the valve 216 is opened, permitting fluid flow passage of the water, under pressure, from the water tank 210 through hose 214 and through conduit 220 and exiting in a stream through discharge opening 224. It should be noted that the trigger 218 in the pistol 200 of FIG. 8 has been relocated from the position shown in FIG. 7, so as to be more accessible to actuation by the thumb of the user, thereby enabling the user to maintain a grip on the handle 14 while squeezing the squeeze bulb pump 92 and operating the trigger 218. In either embodiment, the pump 92 and trigger 218 may be used independently or at the same time, while grasping handle 14 for control of spray direction. These actions can be done ambidextrously and at the same time using only one hand.

Pump Handle

Figure 9:
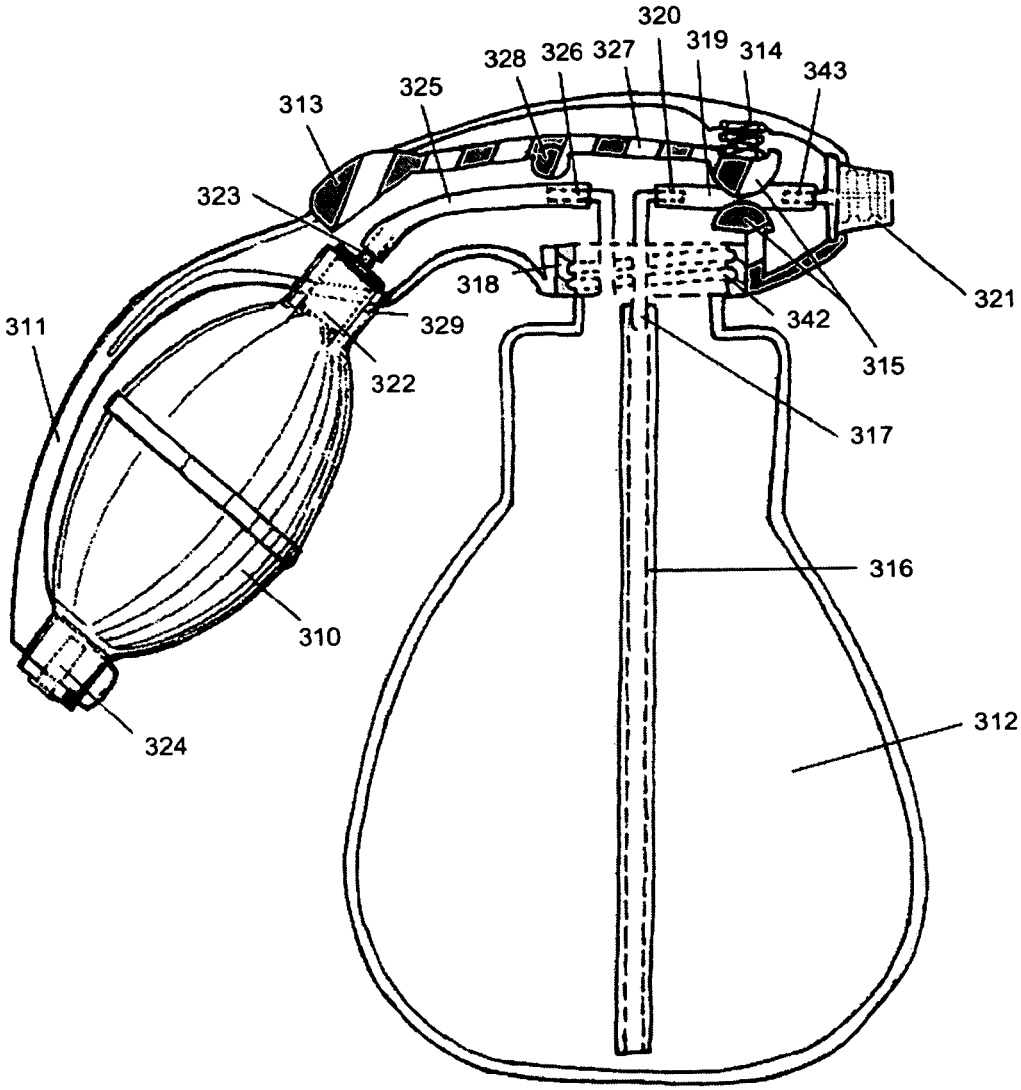
FIG. 9 is a side elevational view, in section, showing a pump handle in combination with a sprayer and threadably engaged to a bottle with the valve in the closed position.

FIG. 9 illustrates another embodiment of the present invention, in which, a bulb style air pump 310 is secured within a handle 311 and permits air to be pumped into bottle 312. A trigger 313 is located on the top of the handle 311. The pump handle includes a tube 316 which goes into the bottle 312 and is connected to a fitting 317 on the bottom of a female threaded cap 318. Cap 318 is threadably engaged to male threads 342. A collapsible tube 319 is connected to a fitting 320 on the outside of cap 318. The opposing end of tube 319, is connected to a fitting 343 of spray nozzle 321. Pump 310 contains two check valves.

Note that the terms "threaded," "threadably engaged" and the like as used herein can refer to traditional threaded engagement (i.e., with a spiral-shaped protrusion extending out from each of the engaging surfaces), and can also refer to other types of attachment mechanisms such as twist locks, snap locks, tongue and groove-type arrangements, etc. of any kind.

When the pump is squeezed, the top check valve 322 allows air out of the pump in one direction. When the pump returns to its bulb shape the bottom check valve 324 allows air into the pump. One end of tube 325 is connected to a fitting 323 of valve 322, the opposing end of tube 325 is connected to a fitting 326 of cap 318. For each pump stroke, air is forced out of check valve 322 into tube 325 and into bottle 312. As pressure in bottle 312 is increased, the liquid within bottle 312 will seek a means of escape.

Figure 12:
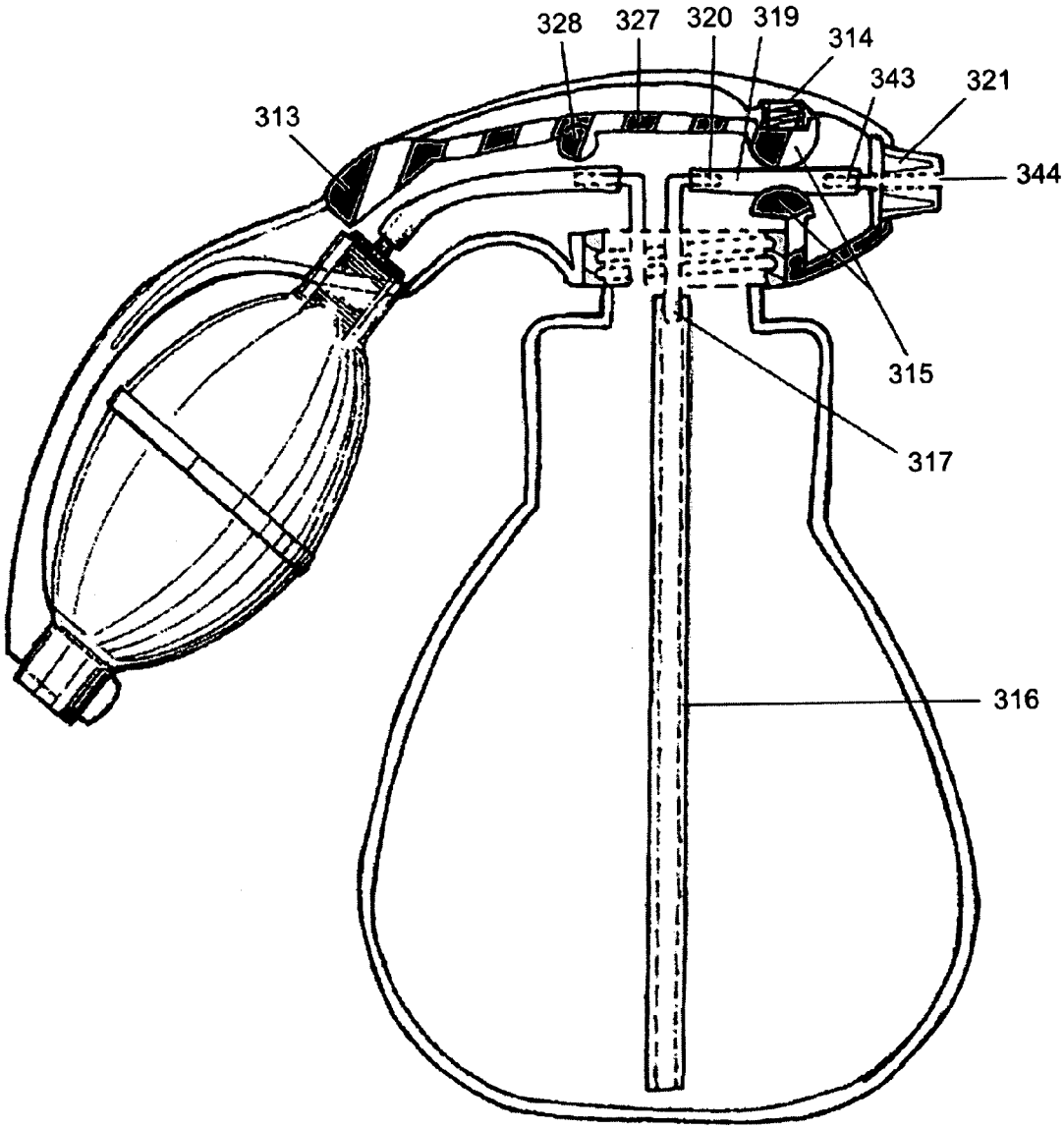
FIG. 12 is a side elevational view, in section showing the pump handle in combination with a sprayer threadably engaged to the bottle with the valve in the open position.

To spray a liquid, as seen in FIG. 12, pressing trigger 313 down will pivot the trigger lever 327 at pivot point 328, allowing tube 319 to open. Then the liquid will travel up tube 316, through fitting 317, out through fitting 320, then through tube 319, into fitting 343 and dispensed out through a perforation 344 of nozzle 321.

To close the valve, as seen in FIG. 9, the compression spring 314 expands forcing lever 327 to pivot downward closing valve 315 and collapsing tube 319. At this point valve 315 is in the closed position.

To control the flow of and volume of liquid, as seen in FIG. 9, turning nozzle 321 in one direction creates a lower volume liquid mist and turning nozzle 321 in the opposite direction creates a liquid stream with more volume.

The nozzle 321 in this and other embodiments may also form a fan spray, i.e., a generally dove-tail shaped spray stream having a generally oval to rectangular spray pattern, as opposed to the typical round spray pattern formed by a conical spray stream. The fan spray is particularly useful for producing even spray coverage over large areas, and is especially effective because the fluid is discharged under pressure.

The nozzle 321 in this and other embodiments may also form a foam. An illustrative foaming nozzle is described in U.S. Pat. No. 4,646,973 to Focaracci and is herein incorporated by reference.

Pump 310 and trigger 313 may be used independently or at the same time, while grasping handle 311 for control of spray direction, these actions can be done ambidextrously and at the same time using only one hand.

Figure 10:
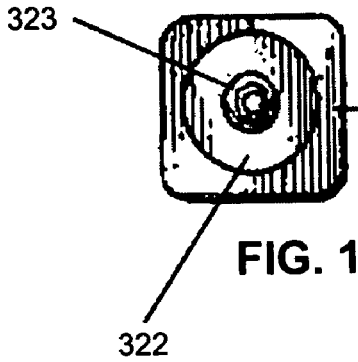
FIG. 10 is a front top plan of the cube shaped end of the bulb air pump.
Figure 11:
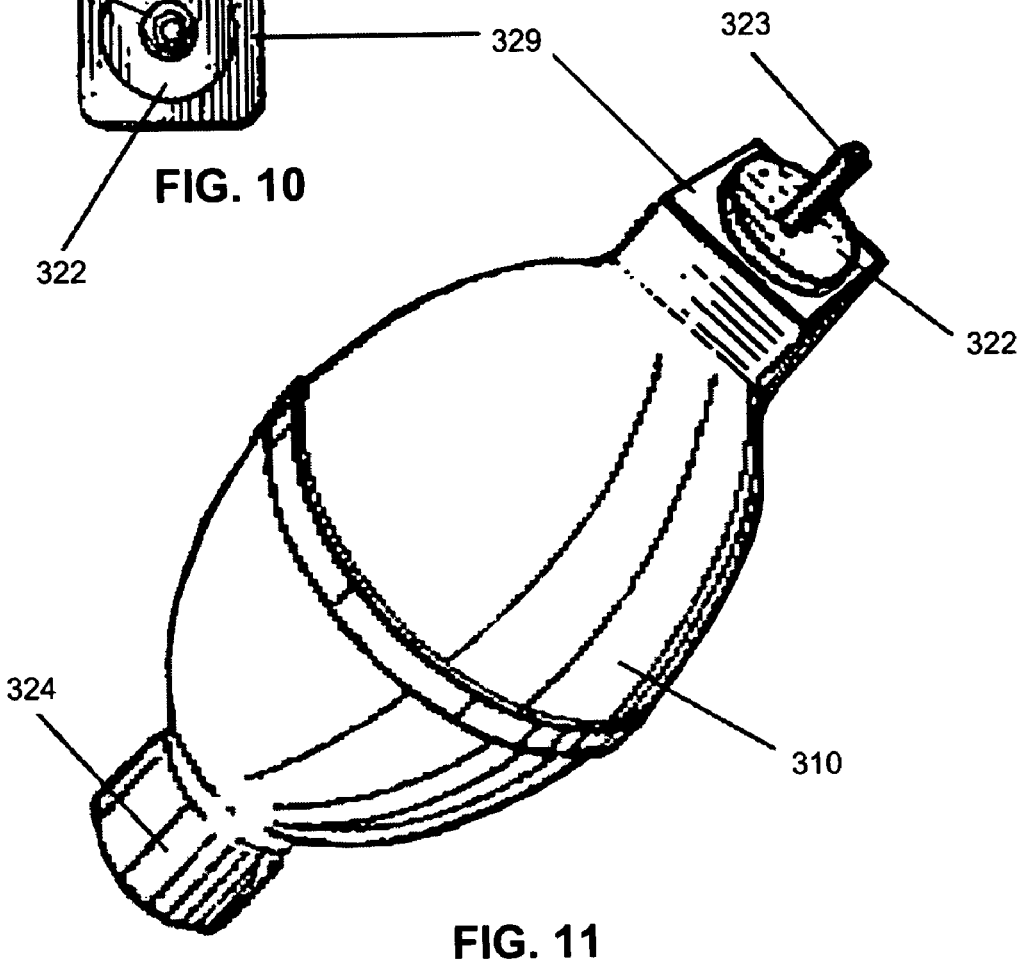
FIG. 11 is a front top perspective view showing the bulb air pump with cube shaped top.

In FIGS. 10 and 11, the cube shape top 329 of pump 310 secures the bulb within handle 311 (FIG. 9), and will not allow it to spin or rotate when pumped. If the pump was permitted to spin or rotate, then tube 325 (FIG. 9) would become kinked, blocked, or even disconnected and thus not permitting air to enter into bottle 312 (FIG. 9) resulting in a nonfunctional pump handle.

Another embodiment of the present invention includes an atomizer. To achieve an aerosol effect for dispensing dense liquids such as cleaning solutions, paint and oils, a pump handle is combined with an atomizer. An atomizer is very effective in achieving a mist when spraying cleaners, food oils and paints. A trigger on the outside center of the handle is engaged to the atomizer spray head. When the trigger is pressed down, the spray head will push down on the atomizer valve and allow the liquid to be propelled through the spray head. The pump and trigger may be used independently or at the same time, while grasping the handle for control of spray direction, these actions can be done ambidextrously and at the same time using only one hand.

As seen in FIGS. 9 and 11, the surface area of pump 310 is generally rounded; the direction of force exerted by the action of pumping may accidentally come from a side angle. If not properly secured, these forces would spin the pump causing twisting of tube 325. Winding and twisting of tube 325 would cause an air blockage or would cause tube 325 to disconnect from fittings 323 and 326.

Figure 13:
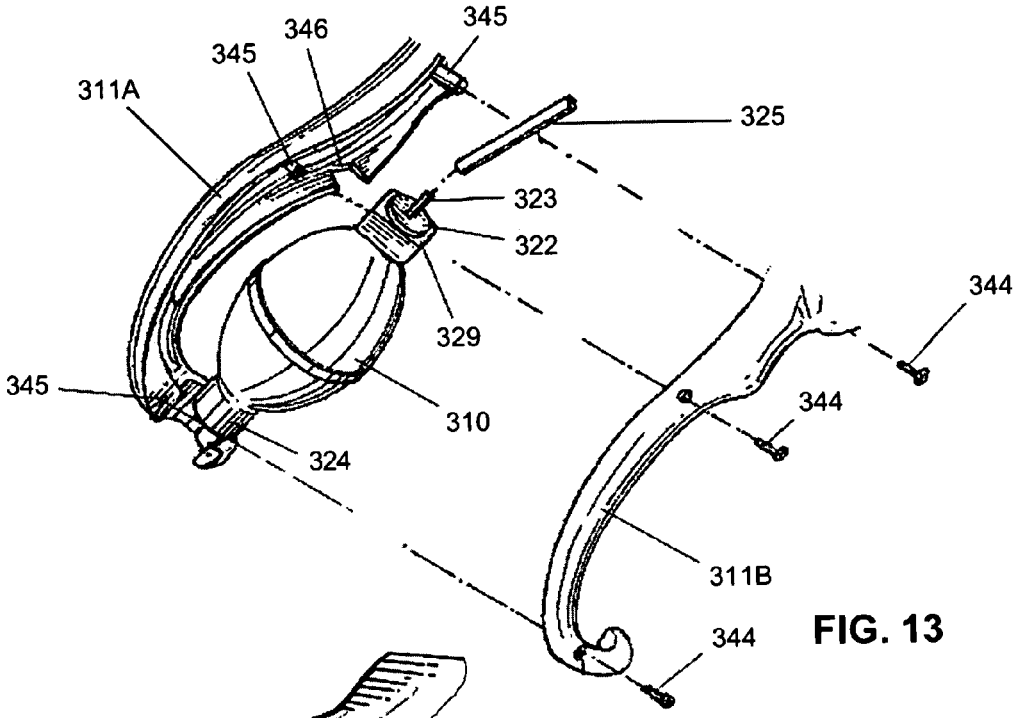
FIG. 13 is an exploded perspective view of the pump handle assembly without a trigger, showing the individual component elements.
Figure 14:
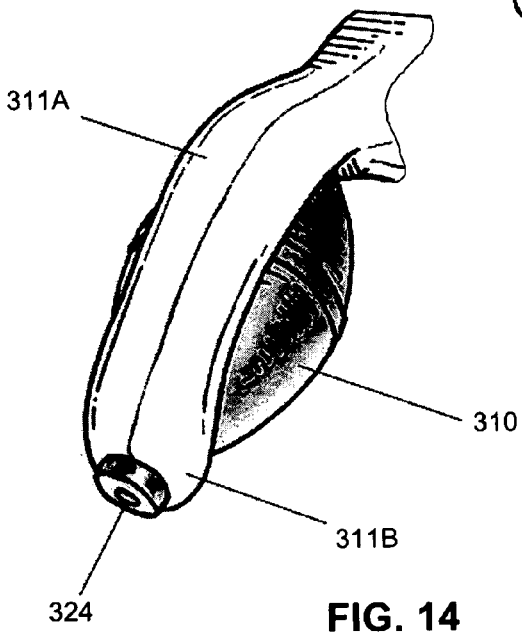
FIG. 14 is back top perspective showing the assembled pump handle without trigger.

To prevent pump 310 from spinning or rotating within handle 311 during manual pumping of pump 310, in FIG. 10, the top of pump 310 is cube shaped 329. As seen in FIGS. 13 and 14, the components which make up the basic pump handle assembly without a trigger are illustrated, a bulb air pump 310 with a top cube shape 329, internal check valves, 324, 322. Pump 310 with the internal check valves 324 and 322 are partially enclosed within the housing of sections 311A and 311B of the handle. Male threaded screws 344 are matted to female threaded holes 345 to secure sections 311A and 311B together. A cube shape 346 is internally formed into the inside of sections 311A and 311B of the handle and when assembled, is designed to match cube shape 329. The matching cube shape restricts any rotational movement of pump 310. Tube 325 connects to fitting 323. The pump handle assembly as seen in FIGS. 13 and 14 may be formed and fitted to become integral of a host device.

The pump handle may have many uses and should not be limited to the embodiments disclosed. The pump handle provides an ambidextrous way to hold, grasp, and manipulate an object with one hand and transfer air into that object using the same hand. With the addition of triggers, the pump handle will allow a user to grasp, pump, and press a trigger with the use of one single hand. There are many devices that can be fitted and formed to be used with the pump handle. These devices include but are not limited to, toys, plant sprayers, water sprayers, chemical sprayers, insecticide sprayers, paint sprayers, food oil misters, hair spray, and the like.

Additional Embodiments

Figure 15:
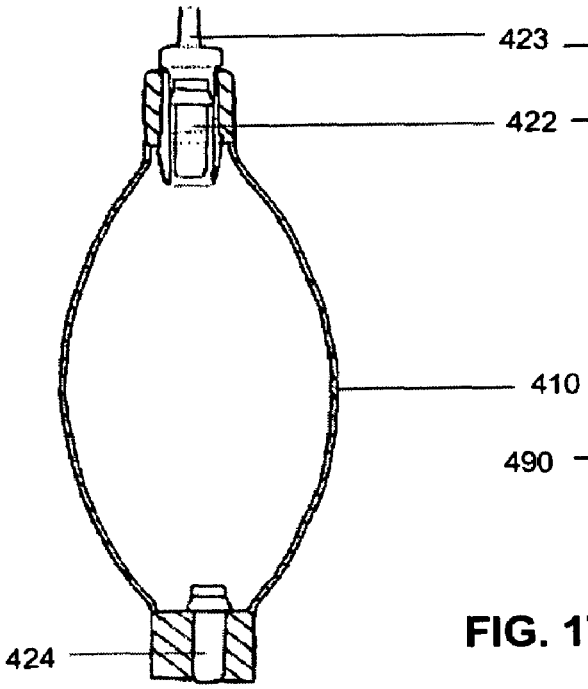
FIG. 15 is a side view, in section, showing a conventional collapsible bulb style air pump with an exhaust check valve located on the top portion and an intake check valve located at the bottom portion.
Figure 16:
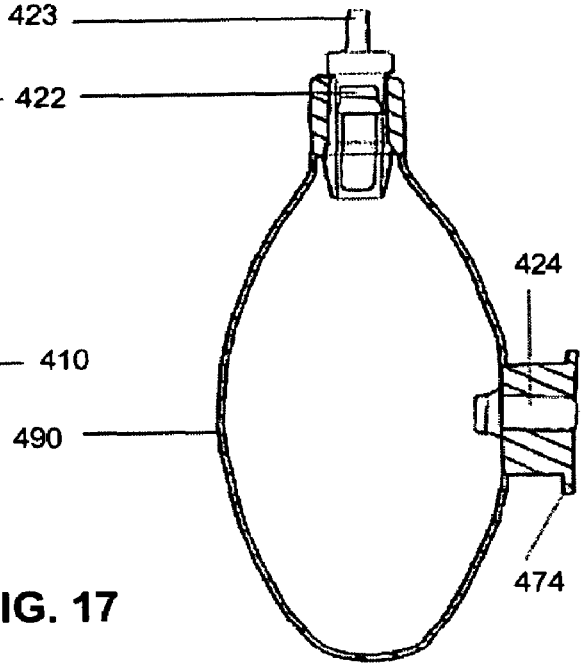
FIG. 16 is a side view, in section, showing a collapsible air pump with an exhaust check valve located on the top portion and the intake check valve located on the side perpendicular to the exhaust valve.
Figure 17:
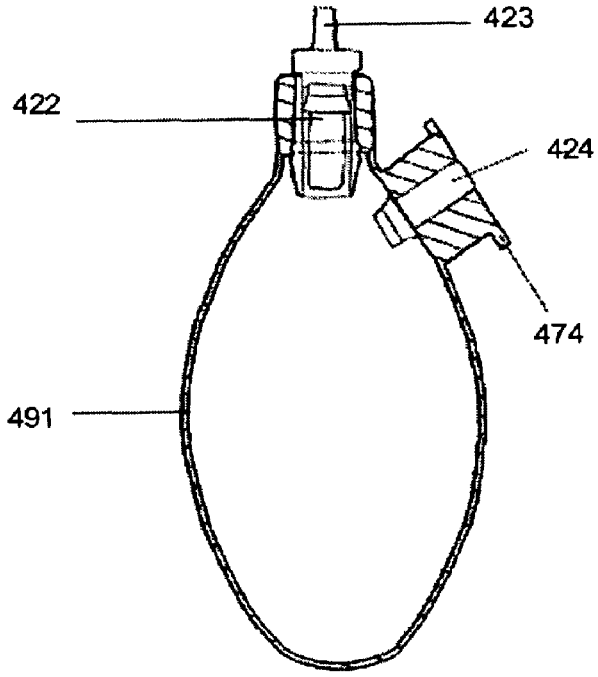
FIG. 17 is a side view, in section, showing a collapsible air pump with the exhaust check valve located on the top portion and the intake check valve located towards the corner top portion adjacent the exhaust valve.

In FIGS. 15, 10, and 11, a conventional collapsible bulb style air pump 410 is shown with a top exhaust check valve 422 housed within fitting 423. Intake check valve 424 is located at the bottom of the pump. When pump 410 is manually squeezed, pump 410 collapses forcing check valve 422 to open as the flow of air is directed out of fitting 423, check valve 424 remains closed. When the pump is manually released, the pump will return to its original shape drawing air in as check valve 424 is opened, check valve 422 remains closed. As shown in FIGS. 10 and 11, the top portion of pump 410 may have a cube shape 429. Pump 410 may be composed of rubber, silicone, or the like.

As seen in FIGS. 16, 18, 19, and 20, a collapsible air pump 490 is shown with a top exhaust check valve 422 housed within fitting 423. Intake check valve 424 is positioned perpendicular to check valve 422. Lip 474 extends over. When pump 490 is manually squeezed, pump 490 collapses forcing check valve 422 to open as the flow of air is directed out of fitting 423, check valve 424 remains closed. When pump 490 is manually released, pump 490 will return to its original shape drawing air in as check valve 424 is opened, check valve 422 remains closed. As seen in FIGS. 18, 19, and 20, the top portion of pump 490 may be cube shaped 429. Pump 490 may be composed of rubber, silicone, or the like.

In FIGS. 17, 21, 22, and 23, a collapsible air pump 491 is shown with a top exhaust check valve 422 housed within fitting 423. Intake check valve 424 is positioned adjacent to check valve 422. Lip 474 extends over. When pump 491 is manually squeezed, pump 491 collapses forcing check valve 422 to open as the flow of air is directed out of fitting 423, check valve 424 remains closed. When pump 491 is manually released, pump 491 will return to its original shape drawing air in as check valve 424 is opened, check valve 422 remains closed. As seen in FIGS. 21, 22, and 23, the top portion of pump 491 may be cube shaped 429. Pump 491 may be composed of rubber, silicone, or the like.

As shown in FIGS. 24–30, a pump sprayer is threadably engaged to bottle 412. Male threads 442 of bottle 412 match the female threads of cap 418 to secure the sprayer to bottle 412. Pump 410 (FIGS. 24–26) is secured within handle 411 and housing 462. Exhaust check valve 422 is housed within fitting 423 and intake check valve 424 is located at the bottom of pump 410. The intake check valve 424 can be held in place by the handle 411, and may be substantially hidden from view by the handle 411, which then would also act as a shield to the intake valve 422, protecting the intake valve 422 from dirt or anything that could interfere with proper operation of the pump. Fitting 423 is connected to tube 425 and the opposing end of tube 425 is connected to fitting 420 of threaded cap 418. Fitting 443 of spray nozzle 421 is connected to a collapsible tube 419 and the opposing end of tube 419 is connected to fitting 426 of threaded cap 418. Trigger 413 is designed to be used with the index finger. Trigger 413 is formed integral with trigger arm 492 which extends across and is connected to compression spring 414. Spring 414 forces arm 492 forward which in turn collapses tube 419 to form pinch valve 415. Tube 416 extends into bottle 412 and is attached to the pump sprayer at inside fitting 417 of threaded cap 418. All the components of the pump sprayer are enclosed within housing 462. When pump 410 is manually squeezed, check valve 424 closes and check valve 422 opens to allow air flow to enter tube 425 out of fitting 423. The air flow will then enter bottle 412 through fitting 420. When pump 410 is manually released, the increased air pressure on the outside of check valve 422 will force check valve 422 to close. As the pump returns to its bulb shape, check valve 424 will open to allow air into the chamber of pump 410. With each stroke of pump 410, the air pressure will increase in bottle 412. The bottle will reach full pressurization when pump 410 feels slightly firm to the touch. As seen in FIG. 25, when trigger 413 is manually pressed in, arm 492 will slide back and compress spring 414 to open pinch valve 415. The air pressure in bottle 412 will force liquid 494 to travel up tube 416 through fittings 417 and 426 then into tube 419. The liquid will then travel from tube 419 through fitting 443 of nozzle 421 and out of perforation 480 into the ambient atmosphere or desired spray surface. When the trigger is manually released, spring 414 will push arm 492 forward to compress tube 419 and close pinch valve 415. To spray intermittently, trigger 413 may be pressed repeatedly until all of the air pressure has been released from the bottle. To spray continuously, the trigger may be held pressed in for a longer duration until all of the air pressure has been released from the bottle. As shown in FIG. 26, handle 411 is a formed integral with housing 462 and forms a full handle. Handle 411 fully surrounds the bottle neck portion of bottle 412. Release valve 439 can be used to release air pressure from the bottle 412.

Figure 27:
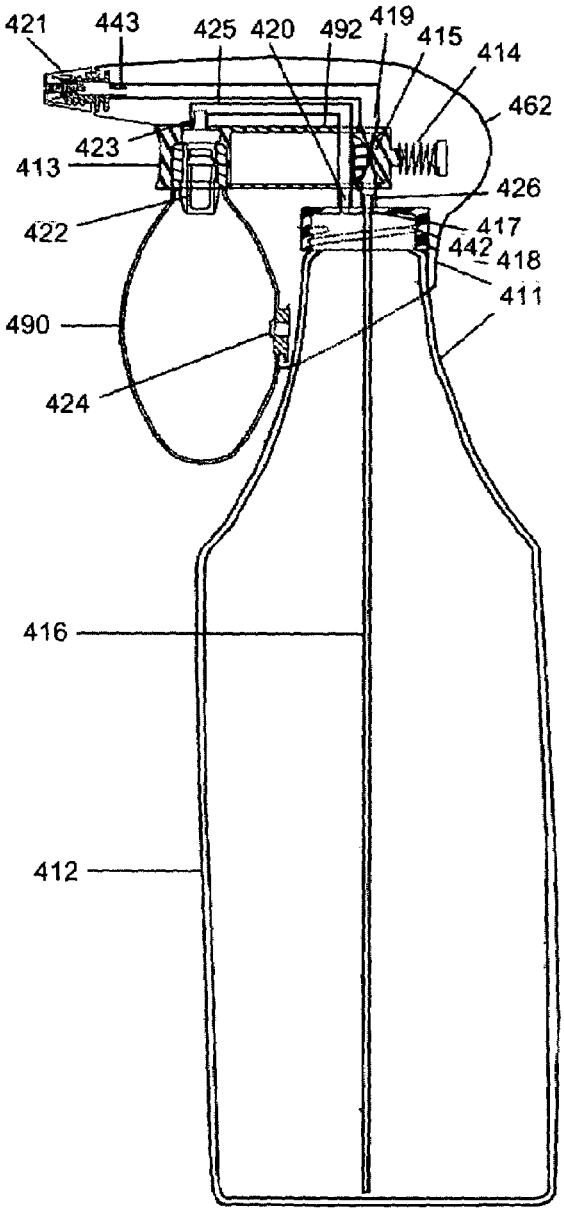
FIG. 27 is a side view, in section, showing a bottle in combination with a pump sprayer interconnected to a collapsible air pump with intake check valve on the side of the pump, the pump is attached to a half handle structure, the pump and trigger are located towards the bottom front corner portion of the sprayer, the valve is in the closed position.
Figure 28:
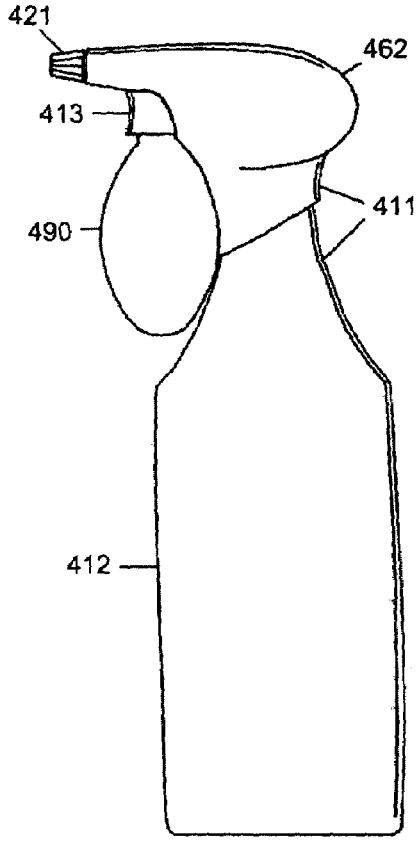
FIG. 28 is a side exterior view showing a bottle in combination with a pump sprayer with the pump and trigger located towards the bottom front corner portion and directly in front of a half handle structure.
Figure 29:
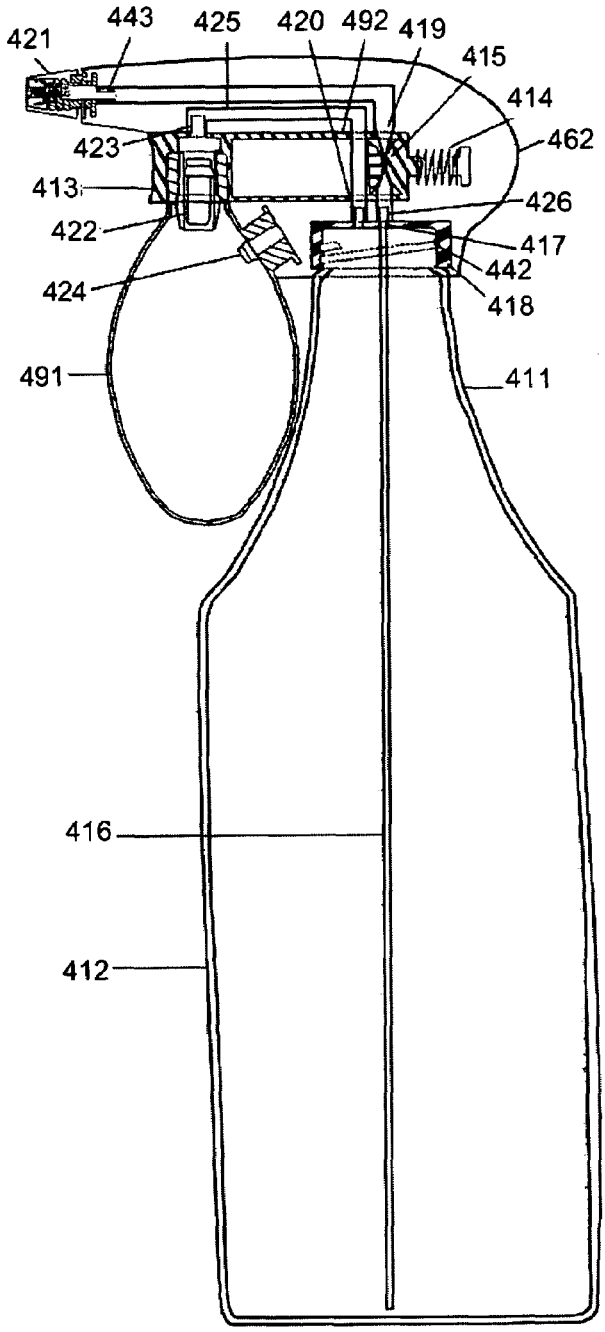
FIG. 29 is a side view, in section, showing a bottle in combination with a pump sprayer interconnected to a collapsible air pump with intake check valve on the top corner adjacent to the exhaust valve, showing the pump and trigger located towards the bottom front corner portion of the sprayer with the bottle forming the handle, the valve is in the closed position.
Figure 30:
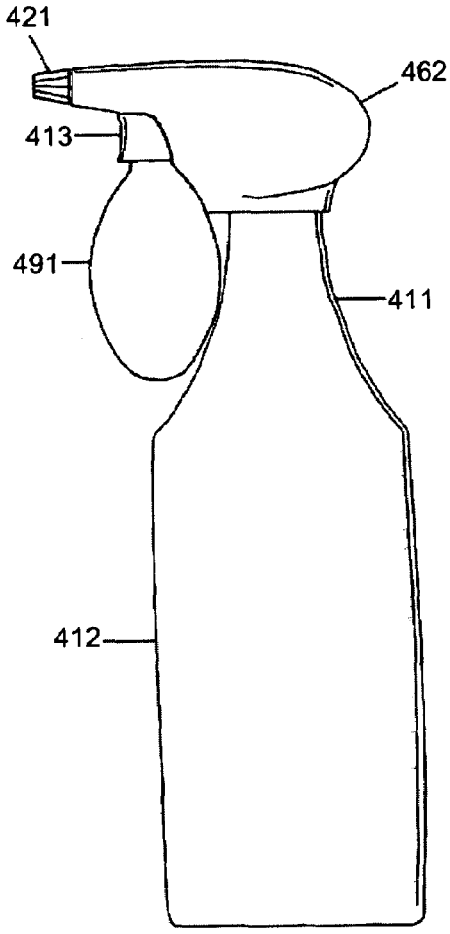
FIG. 30 is a side exterior view showing a bottle in combination with a pump sprayer with the pump and trigger located towards the bottom front corner portion with the bottle forming the handle.

FIGS. 27 and 28 illustrate another embodiment in which pump 490 is attached to handle 411. In this embodiment handle 411 forms a half handle and the bottle neck of bottle 412 forms the rest of the handle. In FIGS. 19 and 20 pump 491 is attached to housing 462. In this embodiment the bottle neck of bottle 412 forms handle 411.

Figure 34:
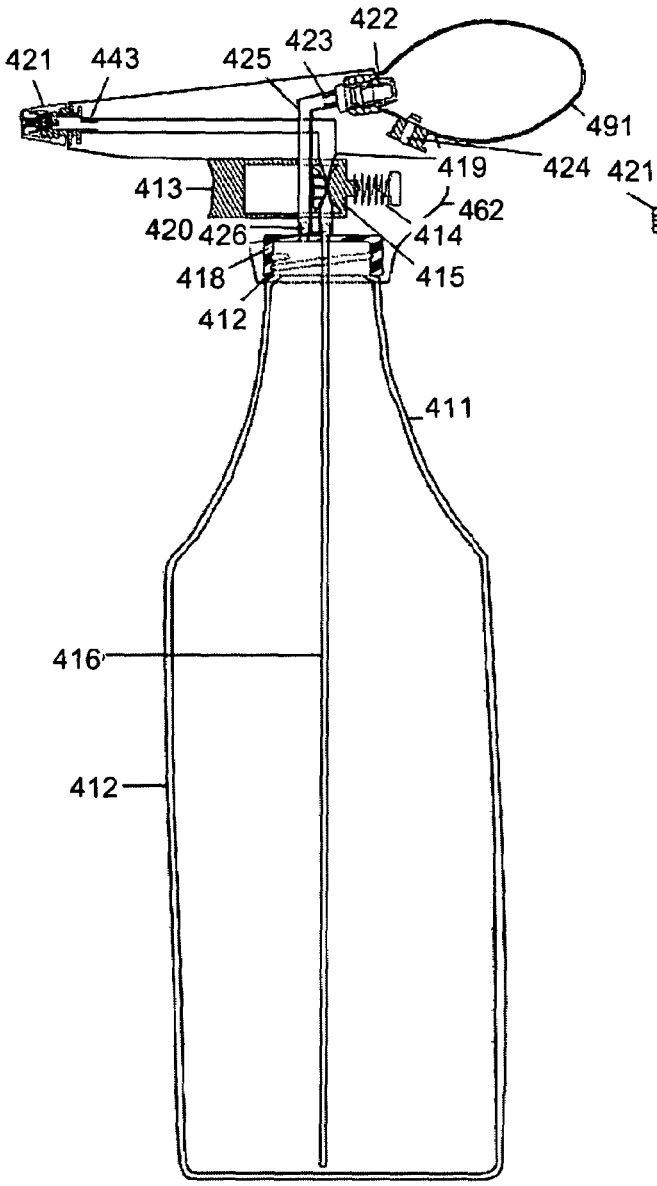
FIG. 34 is a side view, in section, showing a bottle in combination with a pump sprayer interconnected to a conventional bulb style air pump, showing the pump located towards the top back corner portion of the sprayer and the trigger located towards the bottom front corner with the bottle forming the handle, the valve is in the closed position.
Figure 35:
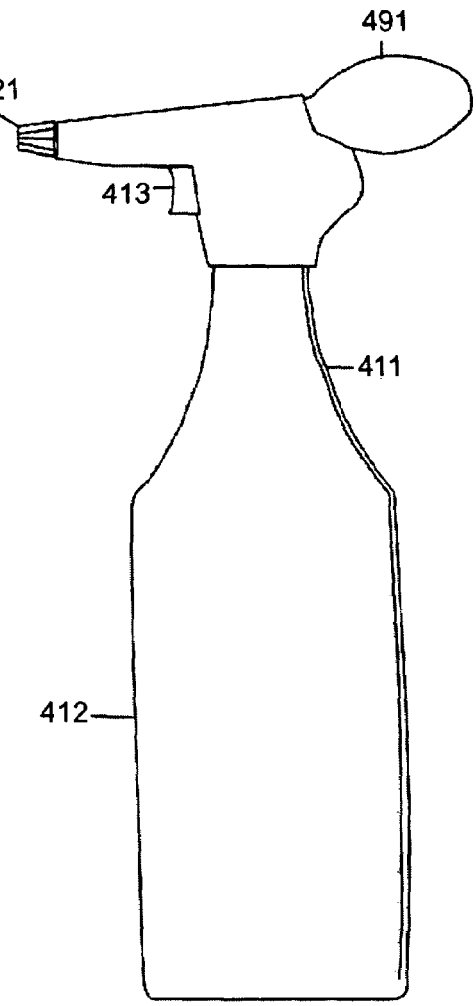
FIG. 35 is a side exterior view showing a bottle in combination with a pump sprayer showing the pump located towards the back top corner and the trigger located towards the bottom front corner portion of the sprayer with the bottle forming the handle.
Figure 36:
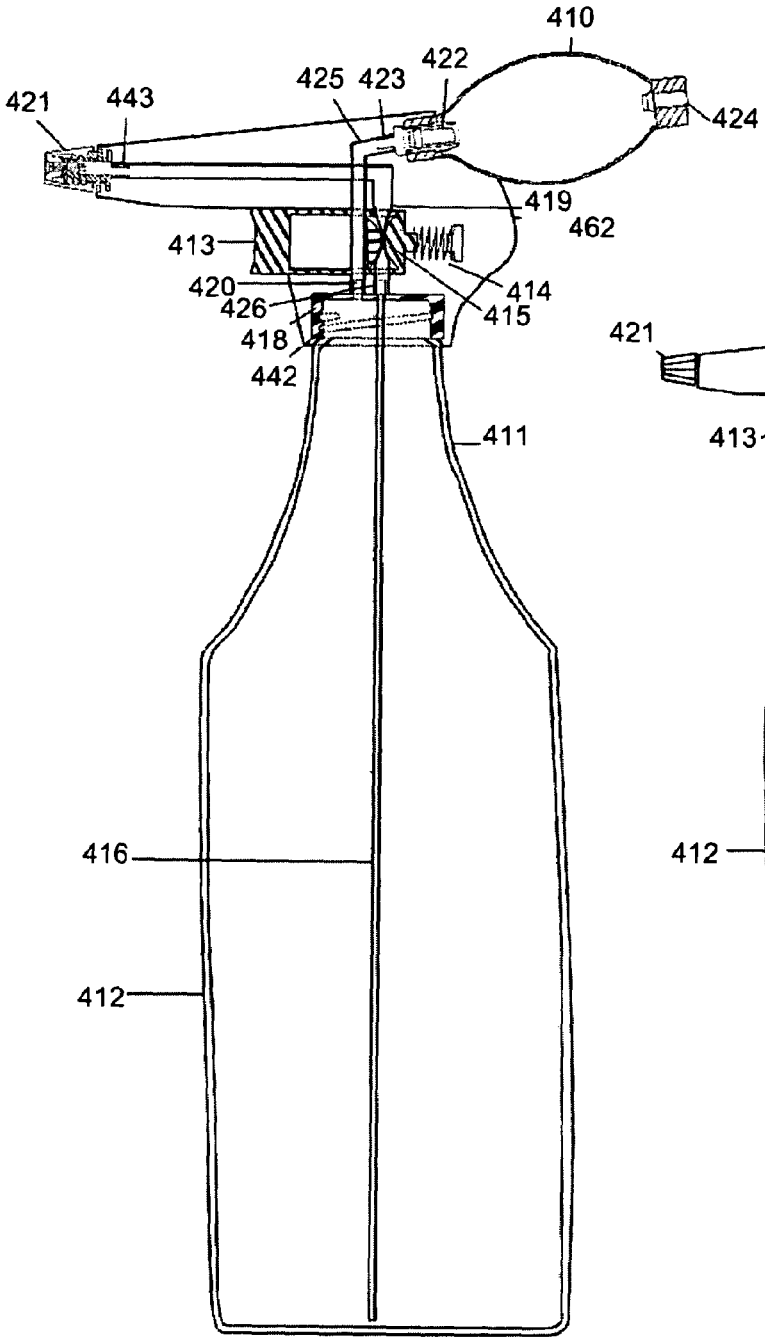
FIG. 36 is a side view, in section, showing a bottle in combination with a pump sprayer interconnected to a conventional bulb style air pump, showing the pump located towards the top back corner portion of the sprayer, the trigger is located towards the bottom front corner with the bottle forming the handle, the valve is in the closed position.
Figure 37:
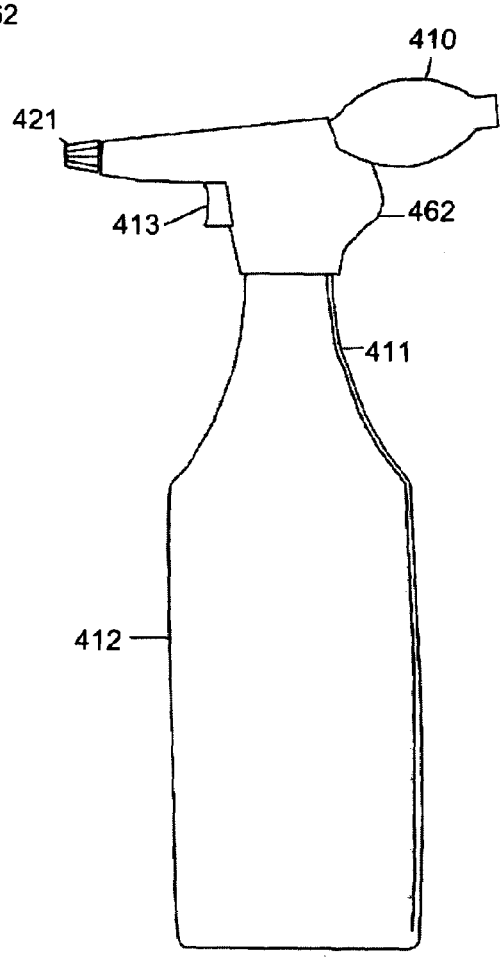
FIG. 37 is a side exterior view showing a bottle in combination with a pump sprayer showing a conventional pump located towards the back top corner and the trigger located towards the bottom front corner portion of the sprayer with the bottle forming the handle.
Figure 38:
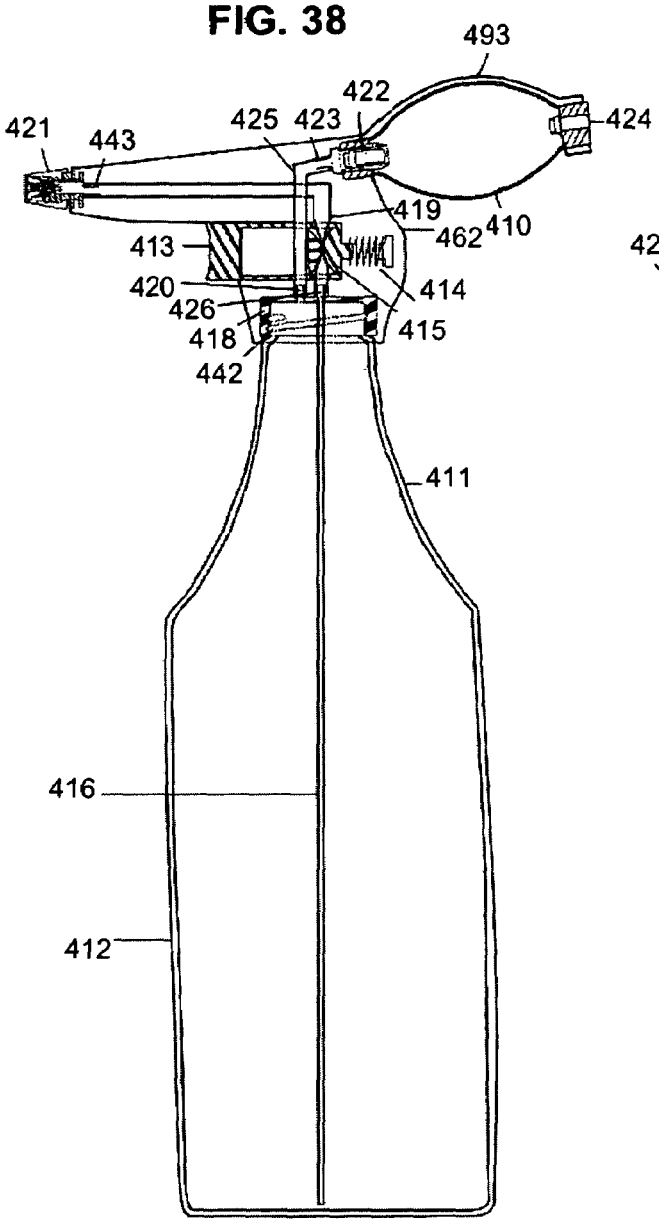
FIG. 38 is a side view, in section, showing a bottle in combination with a pump sprayer interconnected to a conventional bulb style air pump, showing the pump located towards the top back corner portion of the sprayer and is held in place by a fixed handle structure, the trigger is located towards the bottom front corner with the bottle forming the handle, the valve is in the closed position.
Figure 39:
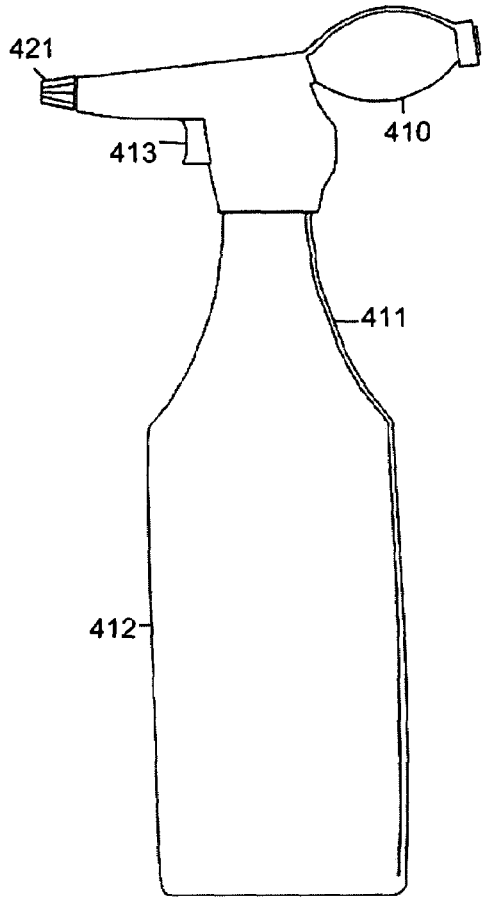
FIG. 39 is a side exterior view showing a bottle in combination with a pump sprayer showing the pump located towards the back top corner and is held in place by a fixed handle structure, the trigger is located towards the bottom front corner portion of the sprayer with the bottle forming the handle.

In the embodiments as shown in FIGS. 31–33, pump 491 is located at the top corner of the pump sprayer. As shown in the embodiment in FIGS. 34 and 35, pump 491 is located towards the back corner of the pump sprayer. In FIGS. 36 and 37, pump 410 is located towards the back corner of the pump sprayer. As seen in FIGS. 38 and 39, pump 410 is located towards the back corner of the pump sprayer and held in place by a rigid handle 493.

Figure 43:
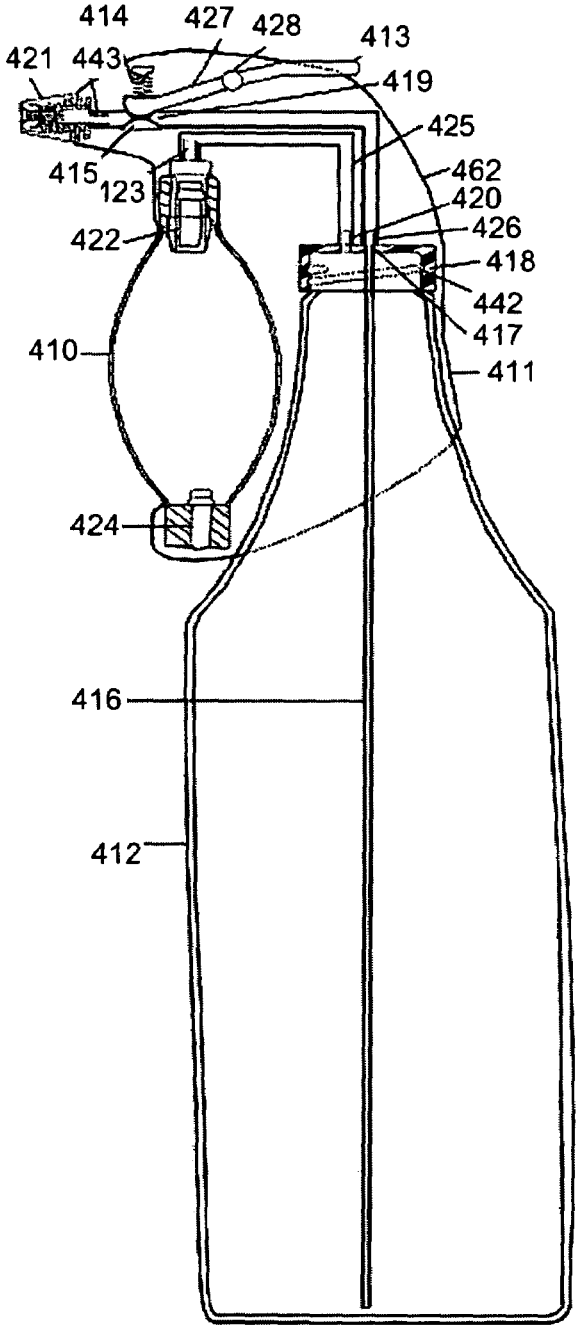
FIG. 43 is a side view, in section, showing a bottle in combination with a pump sprayer interconnected to a conventional bulb style air pump attached within a full handle housing structure, showing the pump located towards the bottom front corner portion of the sprayer and the trigger located towards the top back corner, the valve is in the closed position.
Figure 44:
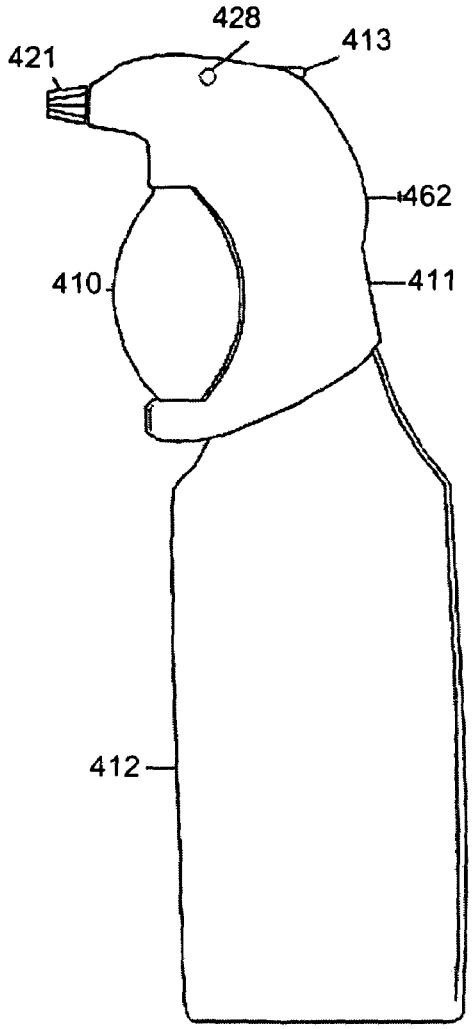
FIG. 44 is a side exterior view showing a bottle in combination with a pump sprayer showing the pump located towards the bottom front corner and the trigger located towards the top back corner portion of the sprayer, the pump attached within a full handle housing structure.
Figure 45:
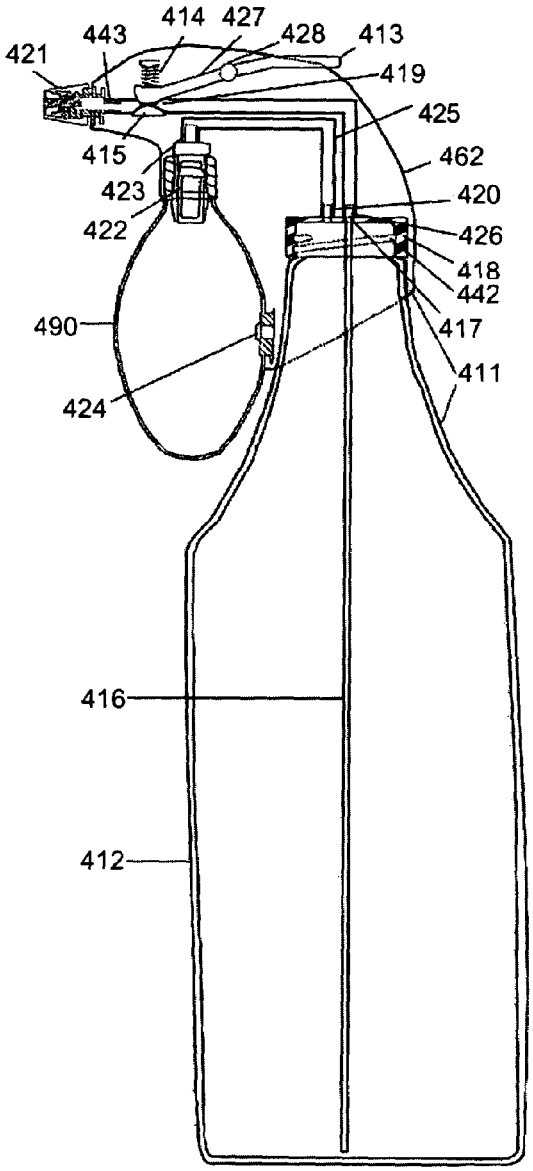
FIG. 45 is a side view, in section, showing a bottle in combination with a pump sprayer interconnected to a collapsible air pump with intake valve on the side perpendicular to the exhaust valve, showing the pump located towards the bottom front corner portion of the sprayer and the trigger located towards the top back corner with a half handle, the valve is in the closed position.
Figure 46:
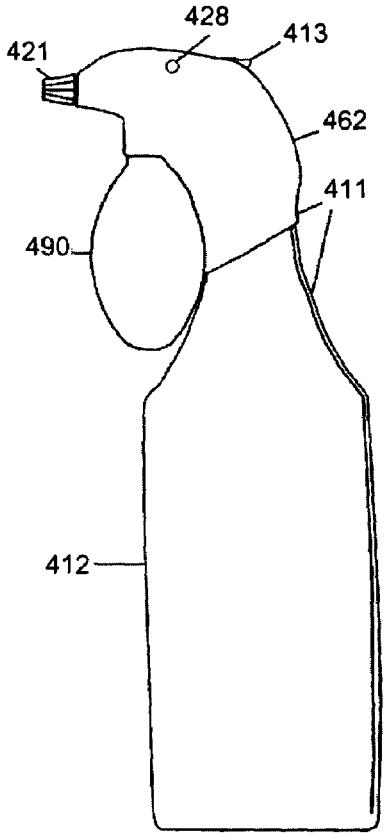
FIG. 46 is a side exterior view showing a bottle in combination with a pump sprayer with the pump located towards the bottom front corner and the trigger located towards the top back corner portion of the sprayer with a half handle.

In FIGS. 40–46, a pump sprayer is threadably engaged to bottle 412. Male threads 442 of bottle 412 match the female threads of cap 418 to secure the sprayer to bottle 412. Pump 491 (FIGS. 40–42) is secured within housing 462. Exhaust check valve 422 is housed within fitting 423 and intake check valve 424 is adjacent valve 422. Fitting 423 is connected to tube 425 and the opposing end of tube 425 is connected to female fitting 420 of threaded cap 418. Fitting 443 of spray nozzle 421 is connected to a collapsible tube 419 and the opposing end of tube 419 is connected to fitting 426 of threaded cap 418. Trigger 413 is on top and is designed to be used with the thumb. Trigger 413 is formed integral with lever 427 which extends across and pivots up and down at pivot point 428. Spring 414 forces lever 427 down to collapses tube 419 to form a pinch valve 415. Tube 416 extends into bottle 412 and is attached to the pump sprayer at female fitting 417 of threaded cap 418. All the components of the pump sprayer are preferably enclosed within housing 462. The bottle neck of bottle 412 forms the handle. When pump 491 is manually squeezed, check valve 424 closes and check valve 422 opens to allow air flow to enter tube 425 and out of fitting 423. The air flow will then enter bottle 412 through female fitting 420. When pump 491 is manually released, the increased air pressure on the outside of check valve 422 will force check valve 422 to close. As the pump returns to its bulb shape, check valve 424 will open to allow air into the chamber of pump 491. With each stroke of pump 491, the air pressure will increase in bottle 412. The bottle will reach full pressurization when pump 491 feels slightly firm to the touch. As seen in FIG. 41, when trigger 413 is manually pressed down, lever 427 will pivot at pivot point 428 compress spring 414 to open pinch valve 415. The air pressure in bottle 412 will force the liquid to travel up tube 416 through fittings 417 and 426 then into tube 419. The liquid will then travel from tube 419 through fitting 443 of nozzle 421 and out of perforation 480 into the ambient atmosphere or desired spray surface. When the trigger is manually released, spring 414 will push lever 427 down to compress tube 419 and close pinch valve 415. To spray intermittently, trigger 413 may be pressed repeatedly until all of the air pressure has been released from the bottle. To spray continuously, the trigger may be held pressed in for a longer duration until all of the air pressure has been released from the bottle. As shown in FIG. 42, the bottle neck of bottle 412 forms handle 411. In the embodiment as shown in FIGS. 43 and 44, pump 410 is located towards the front bottom corner and is held in place by housing 462. As seen in FIG. 44, handle 411 is formed integral with housing 462. In the embodiment as shown in FIGS. 45 and 46, pump 490 is located towards the front bottom corner and is held in place by housing 462. Handle 411 forms a half handle and the bottle neck of bottle 412 forms the rest of the handle.

In a disposable, single use version, the pump sprayer/container combination could be fashioned such that the container cannot be refilled without damage to at least one of the components that make up the pump sprayer/container combination. This can be accomplished by using one-way snap locks that must be deformed or broken to separate.

Figure 47:
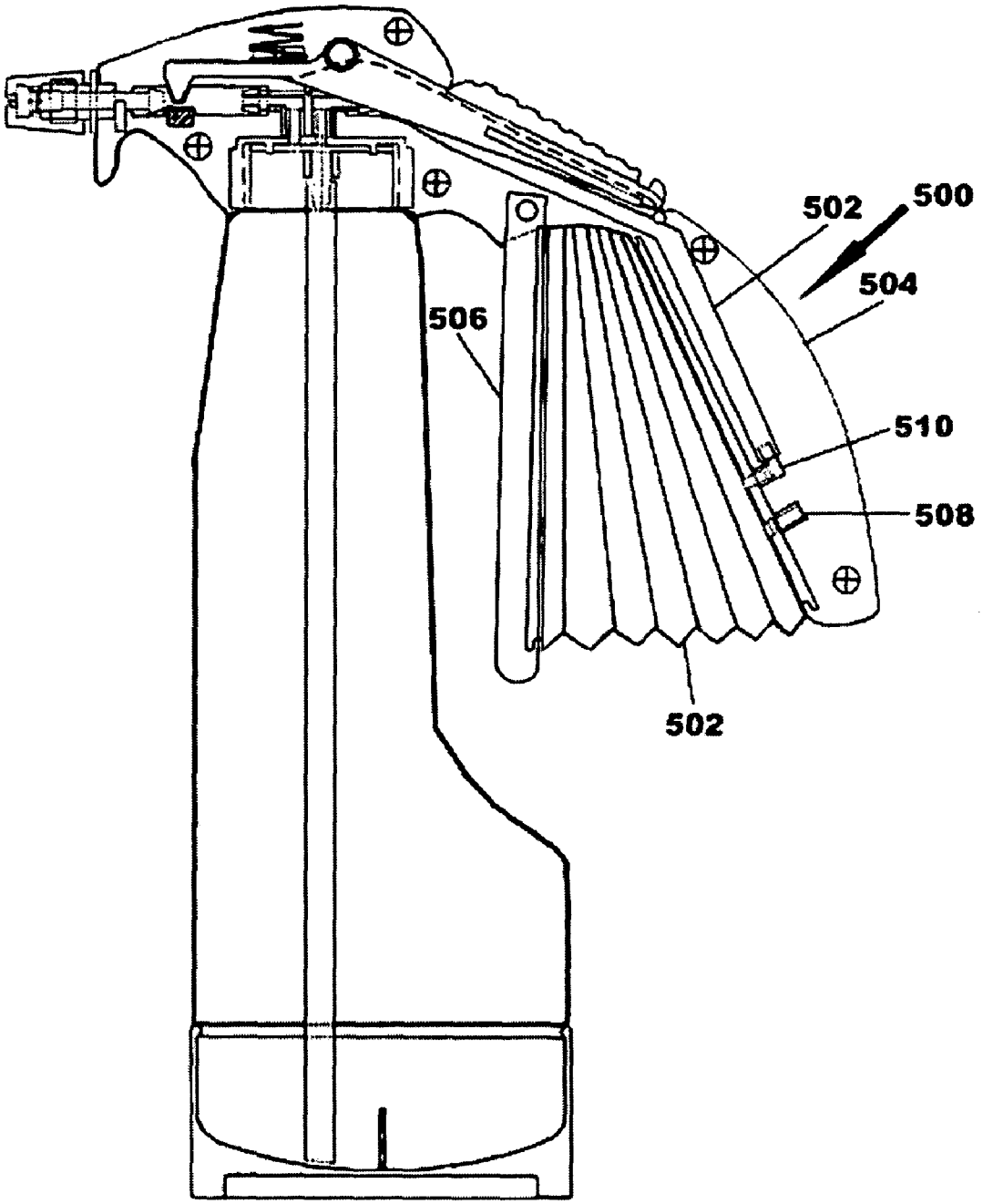
FIG. 47 is a partial side view of a bellows-type pump sprayer.
Figures 48, 49:
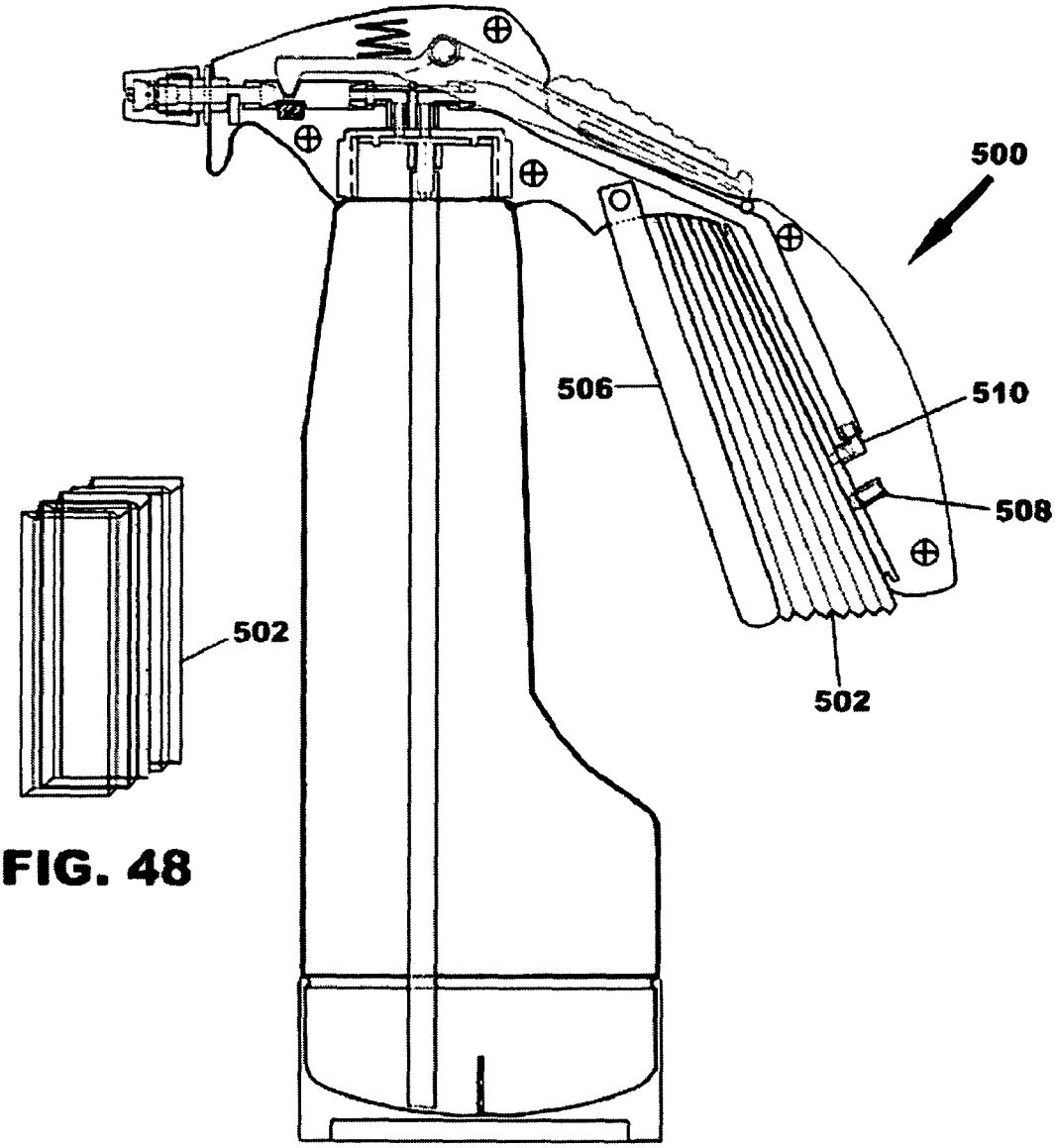
FIG. 48 is a partial perspective view of a bellows for a bellows-type pump sprayer.
FIG. 49 is another partial side view of a bellows-type pump sprayer.

FIGS. 47–49 illustrate another type of pumping mechanism. As shown in FIG. 47, the pump includes a collapsible bellows pump 502 coupled to a handle 504, and also preferably a hinged handle 506 that is biased towards an open position (as shown in FIG. 47). Referring to FIG. 48, the bellows pump can have a generally rectangular shape, but can also be formed in other shapes such as triangular, round, etc.

Referring again to FIGS. 47 and 49, an intake valve 508 and exhaust check valve 510 function generally as described above in the prior embodiments to direct air out of the bellows pump 502 upon collapse and into the air tube 512 connected to the interior of the container to which attached. FIG. 49 illustrates the pumping mechanism with the hinged handle 506 forced towards the handle 504, thereby compressing the bellows pump 502.

In a variation of the pump mechanism shown in FIGS. 47–49, a collapsible diaphragm, bulb, etc. instead of a bellows could be positioned between the handle 504 and hinged handle 506.

In a further variation of the pump mechanism shown in FIGS. 47–49, the hinged handle 506 could be replaced with a moveable handle that does not necessarily pivot when it is pulled back towards the handle 504. The moveable handle would follow one or more guides (e.g., pegs, channels, etc.) that guide the moveable handle towards the handle 504 to compress a collapsible pump.

Figure 50A:
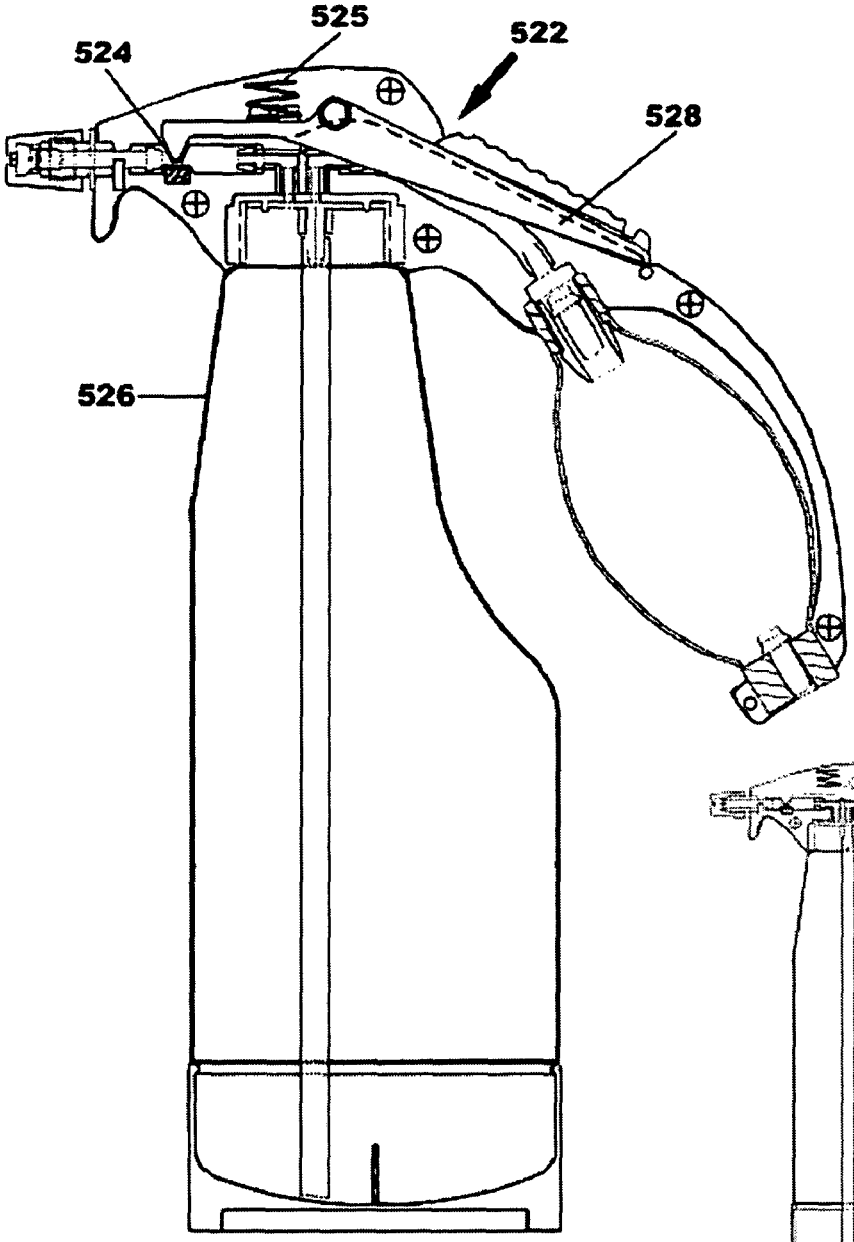
FIGS. 50A–B are cross sectional side views of a spraying device with a locking trigger mechanism with the trigger in a closed position.
Figure 50B:
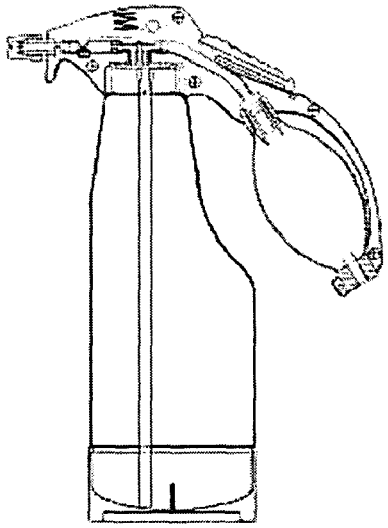
Figure 51:
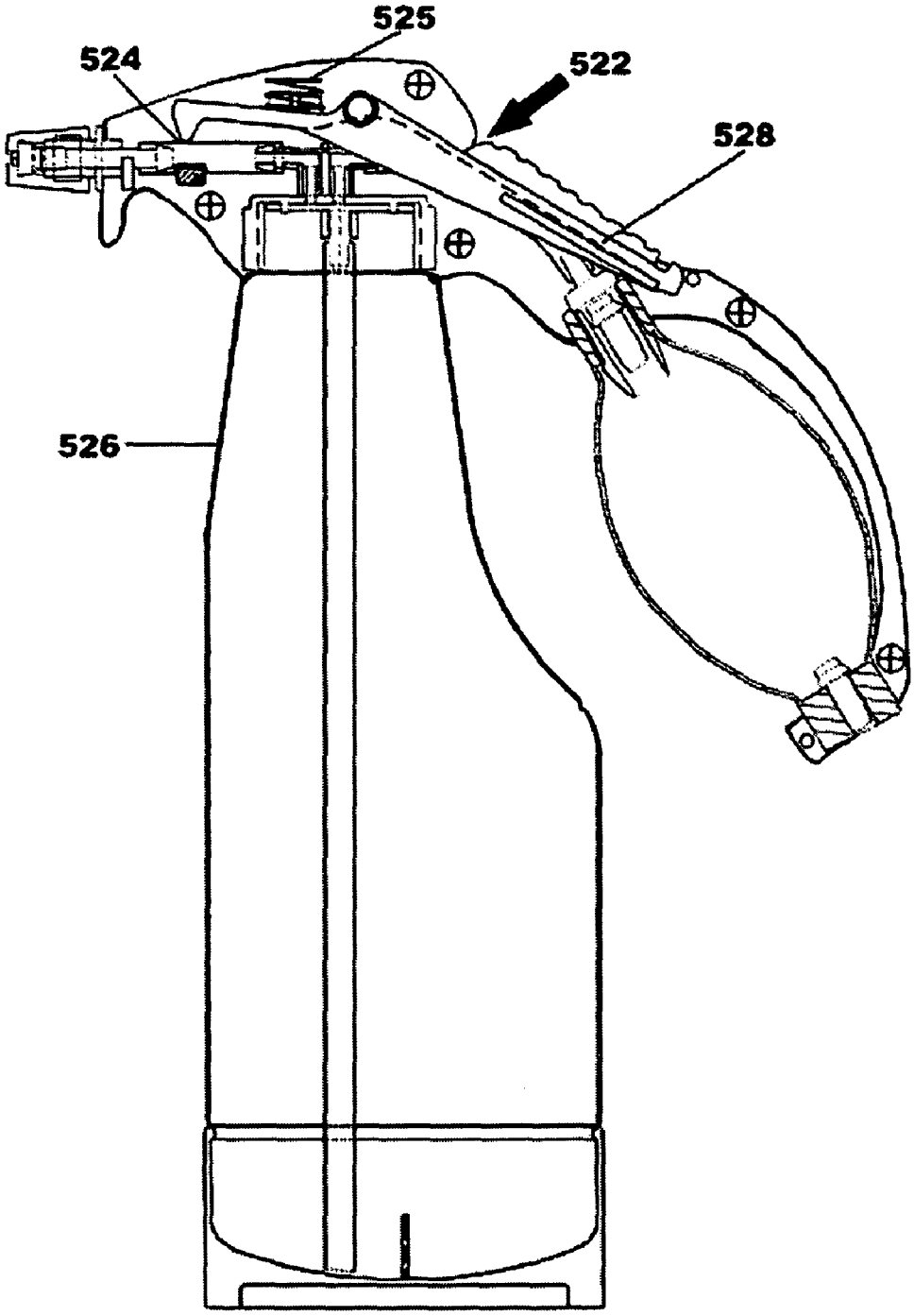
FIG. 51 is a cross sectional side view of a spraying device with a locking trigger mechanism with the trigger in an open position.

FIGS. 50–53B depict a spraying device with an alternate trigger mechanism 522 having a lock-open feature. Any of the pump mechanisms described above can be used with this embodiment. FIG. 50 illustrates the trigger mechanism 522 in a closed position. As shown, the trigger mechanism 522 includes a pinch valve 524 for selectively releasing the contents of the container 526 and a spring 525 for biasing the pinch valve towards the closed postion. Other types of valves can also be used. A trigger 528 is actuated by the user to selectively open and close the pinch valve. FIG. 51 illustrates the pinch valve 524 being open when the trigger 528 is actuated.

Figure 52:
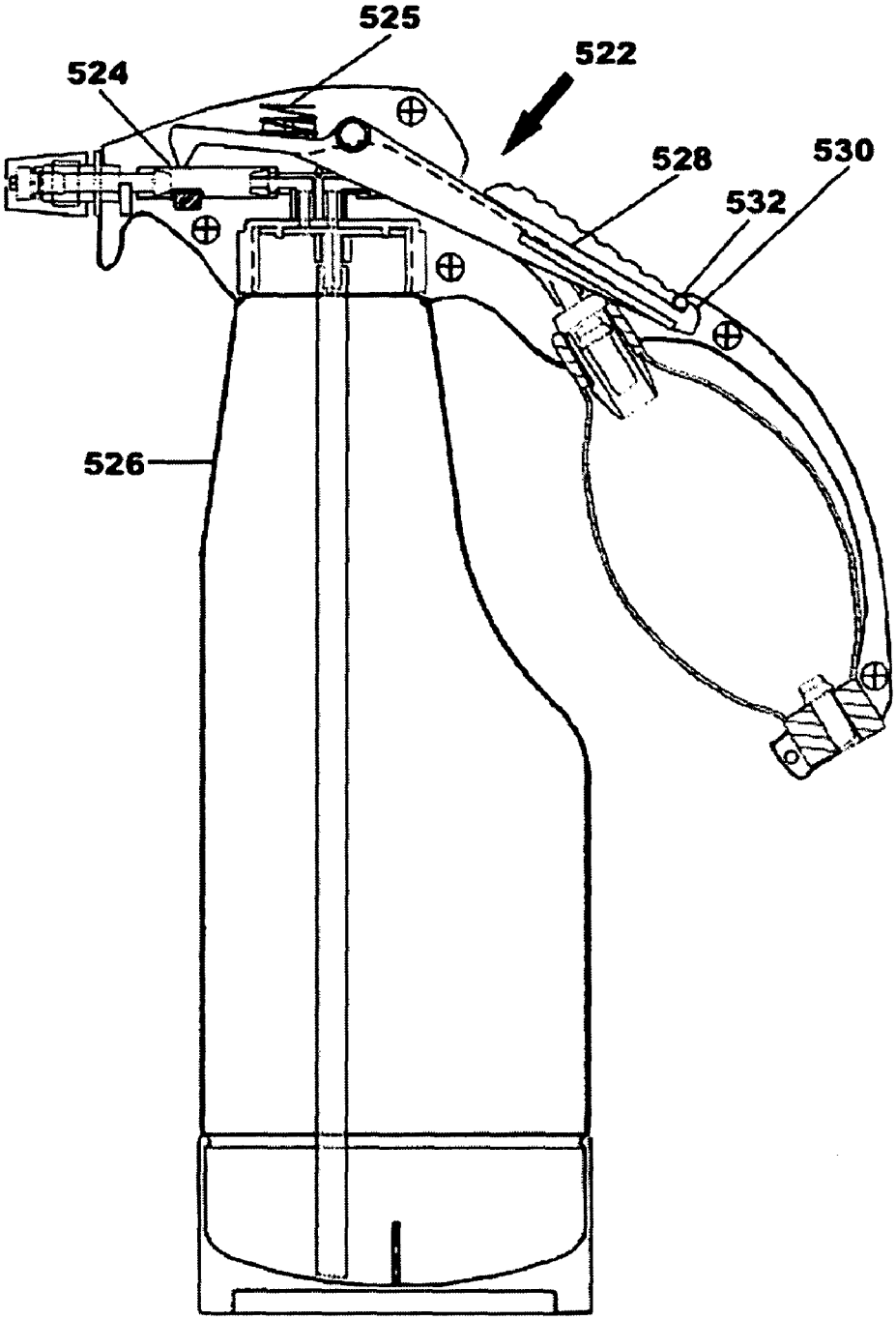
FIG. 52 is a cross sectional side view of a spraying device with a locking trigger mechanism with the trigger in a locked position.

The trigger 528 can preferably be locked in the actuated position by some type of locking mechanism. FIG. 52 illustrates one type of locking mechanism, where the trigger 528 includes a member 530 that hooks on a lip, peg, etc. In the embodiment shown, a portion of the trigger 528 slides slightly towards the pump to engage the member 530 with a peg 532. Alternatively, a sliding clip in the handle could engage the trigger to hold the trigger in an open position.

Figure 53A:
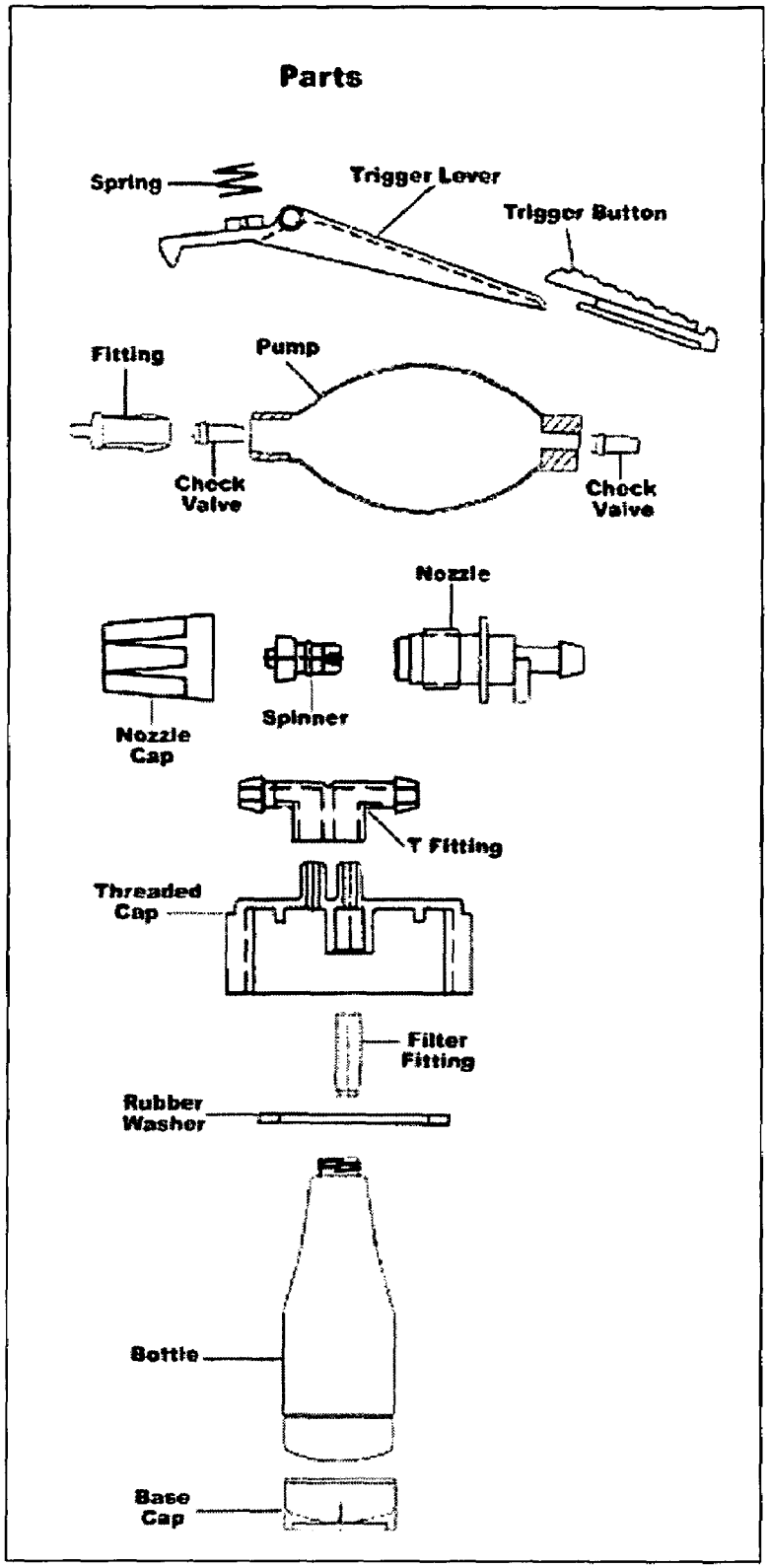
FIG. 53A is a side view of parts of a spraying device with a locking trigger mechanism.
Figure 53B:
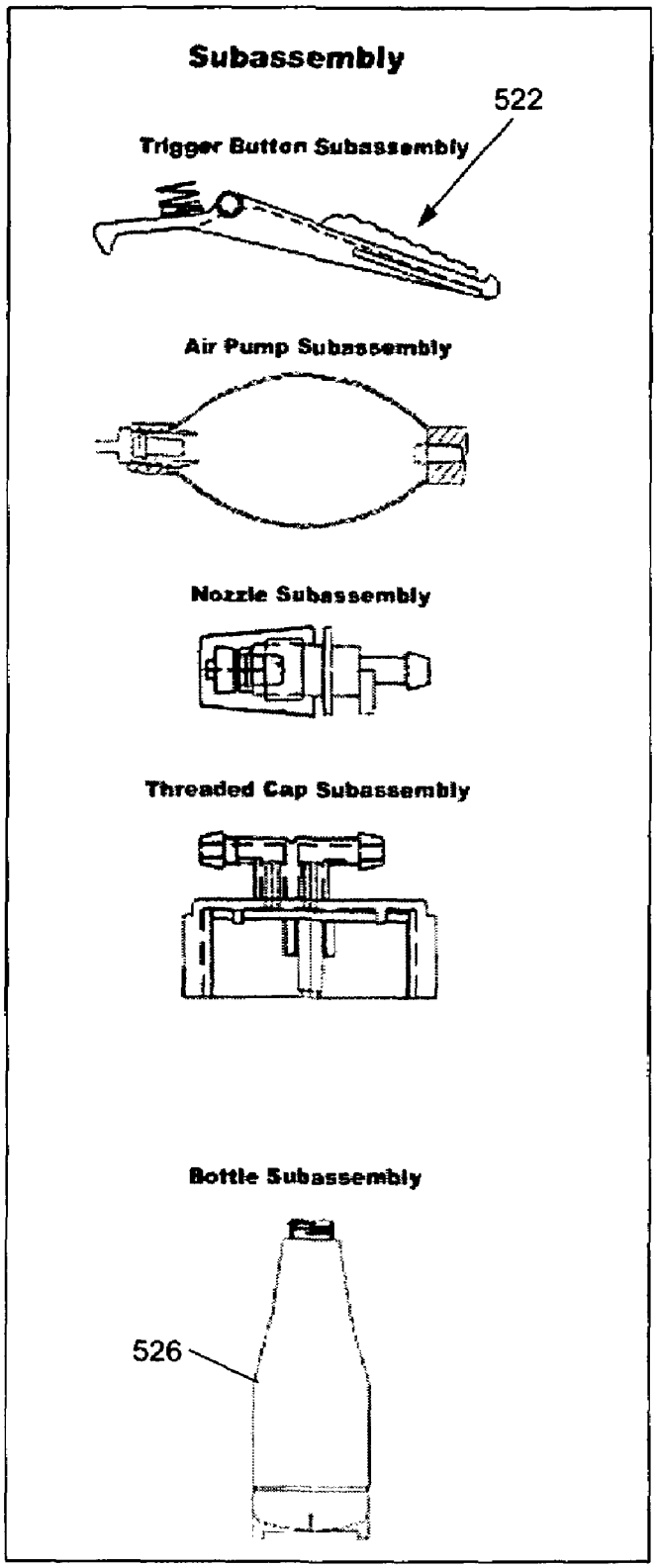
FIG. 53B is a side view of subassemblies of a spraying device with a locking trigger mechanism.

FIGS. 53A and 53B illustrate various parts and corresponding subassemblies of the spraying device of FIGS. 50–52.

The pump sprayer may have many uses and should not be limited to the embodiments disclosed. The pump sprayer may be used to spray, mist, foam, fan spray, atomize, and stream any number of liquids to include but are not limited to, water, plant foods, chemicals, insecticides, paints, oils, hair sprays, disinfectants, cleaners, foaming fluids such as cleaners, and the like.

While the instant invention has been shown and described in accordance with a practical and preferred embodiment thereof, it is recognized that departures from the instant disclosure are contemplated within the spirit of the invention and, therefore, the scope of the invention should not be limited except as defined within the following claims as interpreted under the doctrine of equivalents.

What is claimed is:

1. A device for removable attachment to a fluid container of the type including a threaded neck surrounding a discharge opening in fluid communication with an interior chamber of the fluid container, the device comprising:

a rigid handle portion;

a manually operated pump mechanism coupled to the handle portion, the pump mechanism operative to introduce a charge of pressurized air into the interior of the fluid container, wherein the pump mechanism includes a squeeze bulb;

an air delivery conduit providing fluid communication between the pump mechanism and the interior of the fluid container; and a head portion including:

threads for threaded engagement with the threaded neck of the fluid container thereby providing a substantially airtight seal between the device and the discharge opening of the fluid container to contain the charge of pressurized air and the fluid within the interior chamber of the fluid container; and a valve spout operable between a closed position to contain the fluid and the charge of pressurized air within the interior of the fluid container, and an open position to permit dispensing of the fluid through the discharge opening and from the valve spout;

wherein rotation of the squeeze bulb relative to the handle portion is prevented, wherein the pump mechanism comprises:

a central body surrounding a compressible interior air chamber and operable between a normally relaxed full state and a compressed state;

a first end portion;

a second end portion;

a one-directional intake valve for drawing air into the interior air chamber upon the central body returning to the relaxed state from the compressed state; and a one-directional exhaust valve on the second end portion for directing air outwardly from the interior air chamber and to the air delivery conduit upon the central body being compressed from the relaxed state to the compressed state, wherein rotation of the squeeze bulb relative to the handle portion is prevented by holding the second end portion in a substantially fixed position relative to the handle portion, and wherein the second end of the squeeze bulb is keyed, wherein the handle portion includes a receptacle adapted for keyed receipt of the second end portion of the squeeze bulb to prevent rotation of the squeeze bulb relative to the handle portion upon operation of the manually operated pump mechanism between the normally relaxed full state and the compressed state.

2. A device as recited in claim 1, wherein the air delivery conduit comprises a flexible air hose.

3. A device as recited in claim 1, further comprising a lever for directing operation of the valve spout, wherein the lever is positioned on a same side of the container as the handle portion with respect to the neck of the container.

4. A device for removable attachment to a fluid container of the type including a threaded neck surrounding a discharge opening in fluid communication with an interior chamber of the fluid container, the device comprising:

a rigid handle portion;

a manually operated pump mechanism coupled to the handle portion, the pump mechanism operative to introduce a charge of pressurized air into the interior of the fluid container, wherein the pump mechanism includes a squeeze bulb;

an air delivery conduit providing fluid communication between the pump mechanism and the interior of the fluid container; and a head portion including:

threads for threaded engagement with the threaded neck of the fluid container thereby providing a substantially airtight seal between the device and the discharge opening of the fluid container to contain the charge of pressurized air and the fluid within the interior chamber of the fluid container; and a valve spout operable between a closed position to contain the fluid and the charge of pressurized air within the interior of the fluid container, and an open position to permit dispensing of the fluid through the discharge opening and from the valve spout;

wherein rotation of the squeeze bulb relative to the handle portion is prevented, wherein the pump mechanism comprises:

a central body surrounding a compressible interior air chamber and operable between a normally relaxed full state and a compressed state;

a first end portion;

a second end portion;

a one-directional intake valve for drawing air into the interior air chamber upon the central body returning to the relaxed state from the compressed state; and a one-directional exhaust valve on the second end portion for directing air outwardly from the interior air chamber and to the air delivery conduit upon the central body being compressed from the relaxed state to the compressed state, wherein rotation of the squeeze bulb relative to the handle portion is prevented by holding the second end portion in a substantially fixed position relative to the handle portion, and wherein the second end of the squeeze bulb is keyed, wherein the handle portion includes a receptacle adapted for keyed receipt of the second end portion of the squeeze bulb to prevent rotation of the squeeze bulb relative to the handle portion upon operation of the manually operated pump mechanism between the normally relaxed full state and the compressed state, wherein the keyed second end portion of the squeeze bulb is defined by a multi-sided outer surface, the receptacle of the handle portion having a shape operably congruent to the multi-sided outer surface of the second end portion.

5. A pump handle device, comprising:

a rigid handle portion;

a manually operated pump mechanism fitted to the handle portion and including a collapsible pump comprising:

a central body surrounding a compressible interior air chamber and operable between a normally relaxed full state and a compressed state;

a first end portion;

a second end portion;

a one-directional intake valve means for drawing air into the interior air chamber upon the central body returning to the relaxed state from the compressed state; and a one-directional exhaust valve means on the second end portion for directing air outwardly from the interior air chamber and to the air delivery means upon the central body being compressed from the relaxed state to the compressed state; and a coupling mechanism for securing the collapsible pump to the handle portion and including a mechanism for holding the second end portion in fixed position relative to the handle portion, wherein the second end portion of the collapsible pump is keyed, wherein the handle portion includes a receptacle adapted for keyed receipt of the second end portion of the collapsible pump to prevent rotation of the collapsible pump relative to the handle portion upon operation of the manually operated pump mechanism between the normally relaxed full state and the compressed state.

6. A device as recited in claim 5, wherein the coupling mechanism is structured and disposed to prevent obstruction of airflow exiting the one-directional exhaust valve means.

7. A device as recited in claim 6, further comprising an air delivery means interconnected to the pump mechanism for directing airflow from the pump mechanism to a separate chamber.

8. A device as recited in claim 7, wherein the coupling mechanism is structured and disposed to prevent obstruction of airflow through the air delivery means.

9. A device as recited in claim 8, wherein the air delivery means comprises a flexible air hose.

10. A device as recited in claim 9, wherein the coupling mechanism is structured and disposed to prevent twisting and kinking of the flexible air hose.

11. A device as recited in claim 9, wherein the collapsible pump is a squeeze bulb.

12. A device as recited in claim 9, wherein the collapsible pump is a bellows.

13. A device as recited in claim 5, wherein the coupling mechanism is an adhesive.

14. A device as recited in claim 5, wherein the coupling mechanism is a semi-rigid tube.

15. A device as recited in claim 5, wherein the pump has ends and a peripheral midpoint therebetween, an outlet of the pump being positioned towards an end of the pump, an air inlet of the pump being positioned towards a peripheral midpoint of the pump.

16. A device as recited in claim 5, wherein the pump has ends and a peripheral midpoint therebetween, an outlet of the pump being positioned towards an end of the pump, an air inlet of the pump being positioned between an end and peripheral midpoint of the pump.

17. A device for removable attachment to a fluid container of the type including a neck surrounding a discharge opening in fluid communication with an interior chamber of the fluid container, the device comprising:

a rigid handle portion;

a manually operated pump mechanism coupled to the handle portion, the pump mechanism operative to introduce at least one charge of pressurized air into the interior of the fluid container, wherein the pump mechanism includes a collapsible pump, wherein rotation of the collapsible pump relative to the handle portion is reduced;

an air delivery conduit providing fluid communication between the pump mechanism and the interior of the fluid container and a head portion including:

a container-engaging portion for coupling to the neck of the fluid container;

a fluid conduit for positioning in the interior of the fluid container;

a discharge opening in selective fluid communication with the fluid conduit; and a valve operable between a fully open position and a closed position, the valve permitting fluid from the fluid container to pass through the discharge opening when not in a closed position, wherein the pump mechanism comprises:

a central body surrounding a compressible interior air chamber and operable between a normally relaxed full state and a compressed state;

a first end portion;

a second end portion;

a one-directional intake valve for drawing air into the interior air chamber upon the central body returning to the relaxed state from the compressed state; and a one-directional exhaust valve on the second end portion for directing air outwardly from the interior air chamber and to the air delivery conduit upon the central body being compressed from the relaxed state to the compressed state, wherein the second end portion is held in a substantially fixed position relative to the handle portion for preventing rotation of the squeeze bulb relative to the handle portion, wherein the second end of the squeeze bulb is keyed, wherein the handle portion includes a receptacle adapted for keyed receipt of the second end portion of the squeeze bulb to prevent rotation of the squeeze bulb relative to the handle portion upon operation of the manually operated pump means between the normally relaxed full state and the compressed state.

18. A device as recited in claim 17, wherein the fluid discharge opening is a spray nozzle.

19. A device as recited in claim 18, wherein the spray nozzle is adjustable for changing a spray pattern of a fluid stream flowing therefrom, the spray pattern being selectable from a group consisting of a mist, a conical spray, and a stream.

20. A device as recited in claim 18, wherein the spray nozzle forms a fan spray pattern of a fluid stream flowing therefrom.

21. A device as recited in claim 18, wherein the spray nozzle forms a foam from a fluid stream flowing therefrom.

22. A device as recited in claim 17, wherein the fluid is a hard surface cleaning fluid.

23. A device as recited in claim 17, wherein the fluid is a cleaner for clothing.

24. A device as recited in claim 17, wherein the fluid includes a biocide.

25. A device as recited in claim 17, wherein the fluid includes at least one of an insecticide, an insect repellant, an herbicide, and mixtures thereof.

26. A device as recited in claim 17 , wherein a flow rate of the fluid flowing through the discharge opening is controllable by positioning the valve between the closed position and the fully open position, the flow rate increasing in a substantially linear fashion as the valve moves from the closed position to the fully open position under constant pressure.

27. A device as recited in claim 17, wherein the valve is controllable via a trigger.

28. A device as recited in claim 27, wherein the trigger is adapted for actuation by an index finger of a human.

29. A device as recited in claim 27, wherein the trigger is adapted for actuation by a thumb of a human.

30. A device as recited in claim 17, wherein only one human hand is required to simultaneously hold the device, operate the pump mechanism, operate the valve, and aim the fluid discharge opening.

31. A device as recited in claim 17, wherein the pump is a squeeze bulb.

32. A device for removable attachment to a fluid container of the type including a neck surrounding a discharge opening in fluid communication with an interior chamber of the fluid container, the device comprising:

a rigid handle portion;

a manually operated pump mechanism coupled to the handle portion, the pump mechanism operative to introduce at least one charge of pressurized air into the interior of the fluid container, wherein the pump mechanism includes a collapsible pump, wherein rotation of the collapsible pump relative to the handle portion is reduced;

an air delivery conduit providing fluid communication between the pump mechanism and the interior of the fluid container; and a head portion including:

a container-engaging portion for coupling to the neck of the fluid container; a fluid conduit for positioning in the interior of the fluid container;

a discharge opening in selective fluid communication with the fluid conduit; and a valve operable between a fully open position and a closed position, the valve permitting fluid from the fluid container to pass through the discharge opening when not in a closed position, wherein the pump mechanism comprises:

a central body surrounding a compressible interior air chamber and operable between a normally relaxed full state and a compressed state;

a first end portion;

a second end portion;

a one-directional intake valve for drawing air into the interior air chamber upon the central body returning to the relaxed state from the compressed state; and a one-directional exhaust valve on the second end portion for directing air outwardly from the interior air chamber and to the air delivery conduit upon the central body being compressed from the relaxed state to the compressed state, wherein the second end portion is held in a substantially fixed position relative to the handle portion for preventing rotation of the squeeze bulb relative to the handle portion, wherein the second end of the squeeze bulb is keyed, wherein the handle portion includes a receptacle adapted for keyed receipt of the second end portion of the squeeze bulb to prevent rotation of the squeeze bulb relative to the handle portion upon operation of the manually operated pump means between the normally relaxed full state and the compressed state, wherein the keyed second end portion of the squeeze bulb is defined by a multi-sided outer surface, the receptacle of the handle portion having a shape congruent to the multi-sided outer surface of the second end portion.

33. A spraying device, comprising:

a fluid container including an interior chamber;

a handle portion;

a manually operated pump coupled to the fluid container, the pump operative to introduce at least one charge of pressurized air into the interior of the fluid container, the manually operated pump having a first end portion and a second end portion;

a discharge opening in selective fluid communication with the interior chamber; and a valve operable between a fully open position and a closed position, the valve permitting fluid from the fluid container to pass through the discharge opening when not in a closed position, wherein the second end portion of the manually operated pump is keyed, wherein the handle portion includes a receptacle adapted for keyed receipt of the second end portion of the manually operated pump to prevent rotation of the manually operated pump relative to the handle portion upon operation of the manually operated pump between a relaxed state and a compressed state.

34. A device as recited in claim 33, wherein a human cannot access the interior chamber for refilling the chamber without damaging the device.

35. A device as recited in claim 33, wherein the pump is positioned below the discharge opening when the device is positioned in an upright position.

36. A device as recited in claim 35, wherein an air inlet of the pump is hidden from view by a shield when viewing a profile of the device.

37. A device as recited in claim 35, wherein the pump is positioned in front of a neck of the container; wherein the neck functions as a handle for grasping by a user, wherein only one human hand is required to simultaneously hold the device, operate the pump mechanism, operate the valve, and aim the fluid discharge opening; wherein the valve is controllable via a trigger; wherein the trigger is adapted for actuation by an index finger of the user.

38. A device as recited in claim 33, wherein the pump is positioned above the discharge opening when the device is positioned in an upright position.

39. A device as recited in claim 33, wherein the pump is positioned behind the discharge opening when the device is positioned in an upright position.

40. A device as recited in claim 33, wherein the valve is controllable via a trigger.

41. A device as recited in claim 40, wherein the trigger is adapted for actuation by an index finger of a human.

42. A device as recited in claim 40, wherein the trigger is adapted for actuation by a thumb of a human.

43. A device as recited in claim 33, wherein only one human hand is required to simultaneously hold the device, operate the pump mechanism, operate the valve, and aim the fluid discharge opening.

44. A device as recited in claim 33, further comprising a pressure release valve in fluid communication with the interior of the container.

45. A device as recited in claim 33, wherein the fluid discharge opening is a spray nozzle.

46. A device as recited in claim 45, wherein the spray nozzle forms a fan spray pattern of a fluid stream flowing therefrom.

47. A device as recited in claim 45, wherein the spray nozzle forms a foam from a fluid stream flowing therefrom.

48. A device as recited in claim 33, wherein the discharge opening is adjustable for changing a spray pattern of a fluid stream flowing therefrom, the spray pattern being selectable from a group consisting of a mist, a conical spray, and a stream.

49. A device as recited in claim 33, wherein fluid exiting the discharge opening is in the form of a foam.

50. A device as recited in claim 33, wherein the fluid is a hard surface cleaning fluid.

51. A device as recited in claim 33, wherein the fluid is a cleaner for clothing.

52. A device as recited in claim 33, wherein the fluid includes a biocide.

53. A device as recited in claim 33, wherein the fluid includes at least one of an insecticide, an insect repellant, an herbicide, and mixtures thereof.

54. A device as recited in claim 33, wherein the fluid is a foodstuff.

55. A device as recited in claim 33, wherein a flow rate of the fluid flowing through the discharge opening is controllable by positioning the valve between the closed position and the fully open position, the flow rate increasing in a substantially linear fashion as the valve moves from the closed position to the fully open position under constant pressure.

56. A device as recited in claim 33, wherein the pump is a collapsible pump positioned adjacent a hinged handle.

57. A device as recited in claim 33, wherein the pump is a bellows pump.

58. A device as recited in claim 33, further comprising a semi-rigid tube forming at least part of a conduit connecting the interior of the fluid container to the discharge opening.

59. A device as recited in claim 33, further comprising a semi-rigid tube forming at least part of a conduit connecting the interior of the fluid container to the discharge opening.

60. A device as recited in claim 33, wherein the discharge opening includes a fan sprayer.

61. A device as recited in claim 33, wherein the discharge opening includes a foam sprayer.

62. A device as recited in claim 33, wherein the pump has ends and a peripheral midpoint therebetween, an outlet of the pump being positioned towards an end of the pump, an air inlet of the pump being positioned towards a peripheral midpoint of the pump.

63. A device as recited in claim 33, wherein the pump has ends and a peripheral midpoint therebetween, an outlet of the pump being positioned towards an end of the pump, an air inlet of the pump being positioned between an end and peripheral midpoint of the pump.

64. A device as recited in claim 33, wherein the pump has ends and a peripheral midpoint therebetween, an outlet of the pump being positioned towards an end of the pump, an air inlet of the pump being positioned between an end and peripheral midpoint of the pump.

65. A device as recited in claim 33, wherein a neck of the container functions as a handle.

66. A device as recited in claim 33, wherein the device is a water pistol.

* * * * *